US011509052B2

(12) United States Patent
Ramasamy et al.

(10) Patent No.: US 11,509,052 B2
(45) Date of Patent: Nov. 22, 2022

(54) SMART ANTENNA CONTROLLER SYSTEM

(71) Applicant: Dell Products L.P., Round Rock, TX (US)

(72) Inventors: Suresh Ramasamy, Cedar Park, TX (US); Manoj Jain, Austin, TX (US); Sumana Pallampati, Austin, TX (US); Ching Wei Chang, Cedar Park, TX (US); Changsoo Kim, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/031,459

(22) Filed: Sep. 24, 2020

(65) Prior Publication Data

US 2022/0094055 A1 Mar. 24, 2022

(51) Int. Cl.

| | |
|---|---|
| ***H01Q 3/36*** | (2006.01) |
| ***H01Q 21/28*** | (2006.01) |
| ***H01Q 1/22*** | (2006.01) |
| ***H01Q 3/44*** | (2006.01) |
| ***H01Q 5/307*** | (2015.01) |
| ***H01Q 1/00*** | (2006.01) |
| ***H01Q 5/49*** | (2015.01) |
| ***H01Q 1/24*** | (2006.01) |

(52) U.S. Cl.

CPC ..... *H01Q 3/36* (2013.01); *H01Q 1/002* (2013.01); *H01Q 1/2291* (2013.01); *H01Q 1/245* (2013.01); *H01Q 3/44* (2013.01); *H01Q 5/307* (2015.01); *H01Q 5/49* (2015.01); *H01Q 21/28* (2013.01)

(58) Field of Classification Search

CPC .. H01Q 3/26; H01Q 3/36; H01Q 5/49; H01Q 1/002; H01Q 5/307; H01Q 1/2291; H01Q 1/245; H01Q 3/44; H01Q 21/28

See application file for complete search history.

(56) References Cited

U.S. PATENT DOCUMENTS

| | | | | |
|---|---|---|---|---|
| 2016/0286169 | A1* | 9/2016 | Sannala | G08B 25/10 |
| 2019/0140340 | A1* | 5/2019 | Ramasamy | H01Q 1/2291 |
| 2020/0136696 | A1* | 4/2020 | El-Rayis | H04B 7/0404 |
| 2020/0335867 | A1* | 10/2020 | Choudhury | H01Q 9/0414 |

* cited by examiner

*Primary Examiner* — Andrea Lindgren Baltzell
*Assistant Examiner* — Yonchan J Kim
(74) *Attorney, Agent, or Firm* — Terrile, Cannatti & Chambers; Stephen A. Terrile

(57) ABSTRACT

An information handling system (IHS) includes an antenna system. The antenna system includes a smart antenna and a smart antenna control system, the smart antenna control system controlling configuration of a configurable aspect of the smart antenna based upon information regarding the configurable aspect of the smart antenna.

20 Claims, 13 Drawing Sheets

SMART ANTENNA CONTROLLER SYSTEM

BACKGROUND OF THE INVENTION

Field of the Disclosure

The present disclosure generally relates to information handling systems, and more particularly relates to a modular smart antenna controller system used within an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, read-only memory (ROM), and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components. The information handling system may also include telecommunication, network communication, and video communication capabilities. The information handling system may also include one or more buses operable to transmit communications between the various hardware components. The information handling system may also include telecommunication, network communication, and video communication capabilities. Information handling system chassis parts may include case portions such as for a laptop information handling system including the C-cover over components designed with a metal structure. The information handling system may be configurable with one or more antenna systems located within the chassis.

SUMMARY

In one embodiment, the invention relates to a method for controlling a smart antenna within an information handling system, comprising: providing the smart antenna with at least one configurable aspect; obtaining information regarding the configurable aspect; and, controlling configuration of the configurable aspect of the smart antenna based upon the information regarding the configurable aspect of the smart antenna, the controlling being performed via a smart antenna control system.

In another embodiment, the invention relates to a system comprising: a processor; a data bus coupled to the processor; a smart antenna system, the smart antenna system comprising at least one configurable aspect; and a non-transitory, computer-readable storage medium embodying computer program code, the non-transitory, computer-readable storage medium being coupled to the data bus, the computer program code interacting with a plurality of computer operations and comprising instructions executable by the processor and configured for: obtaining information regarding the configurable aspect; and, controlling configuration of the configurable aspect of the smart antenna based upon the information regarding the configurable aspect of the smart antenna, the controlling being performed via a smart antenna control system.

In another embodiment, the invention relates to a non-transitory, computer-readable storage medium embodying computer program code for controlling a smart antenna, the smart antenna comprising at least one configurable aspect, the computer program code comprising computer executable instructions configured for: obtaining information regarding the configurable aspect; and, controlling configuration of the configurable aspect of the smart antenna based upon the information regarding the configurable, aspect of the smart antenna, the controlling being performed via a smart antenna control system.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
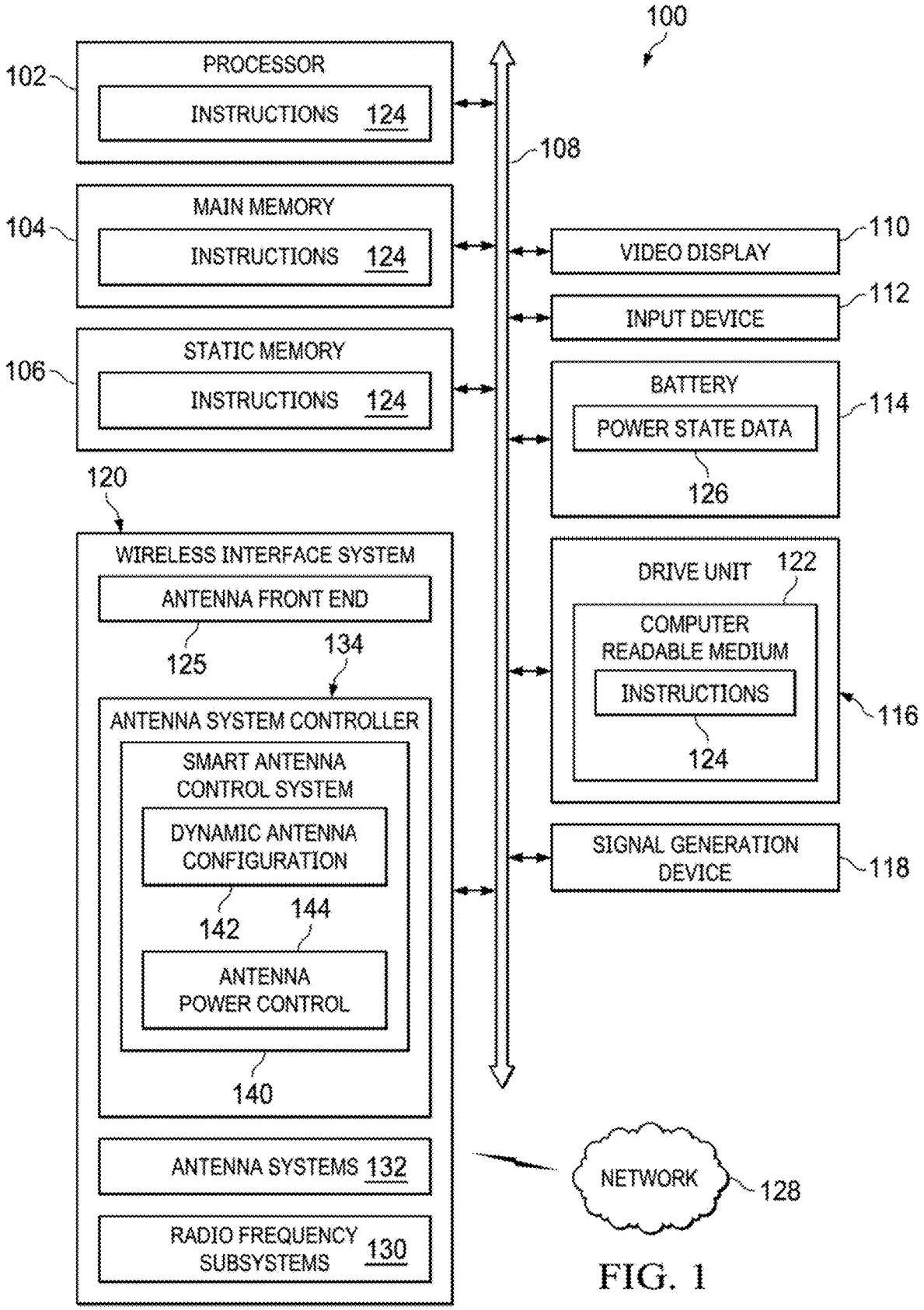
FIG. 1 shows a general illustration of components of an information handling system as implemented in an embodiment of the system and method of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

For aesthetic, strength, and performance reasons, information handling system chassis parts may be designed with a metal structure. In an embodiment, a laptop information handling system, for example, may include a plurality of covers for the interior components of the information handling system. In these embodiments, a form factor case may include an "A-cover" which serves as a back cover for a display housing and a "B-cover" which may serve as the bezel, if any, and a display screen of the convertible laptop information handling system in an embodiment. In a further example, the laptop information handling system case may include a "C-cover" housing a keyboard, touchpad, and any cover in which these components are set and a "D-cover" base housing for the laptop information handling system.

With the need for utility of lighter, thinner, and more streamlined devices, the use of full metal portions for the outer covers of the display and base housing (e.g., the A-cover and the D-cover) is desirable for strength as well as aesthetic reasons. At the same time, the demands for wireless operation also increase. This includes addition of many simultaneously operating radiofrequency (RF) systems, addition of more antennas, and utilization of various antenna types. In the present specification and in the appended claims, the term "radio frequency" is meant to be understood as the oscillation rate of an electromagnetic wave. A specific frequency of an electromagnetic wave may have a wavelength that is equal to the speed of light (300,000 km/s) divided by the frequency.

With new types of networks being developed such as 5G networks, additional antennas that operate on frequencies related to those 5G networks (i.e., high frequency (HF) band, very high frequency (VHF) band, ultra-high frequency (VHF) band, L band, S band, C band, X band, Ku band, K band, Ka band, V band, W band, and millimeter wave bands). So as to communicate with the existing networks as well as the newly developed networks, additional antennas may be added to an information handling system. However, the thinner and more streamlined devices have fewer locations and area available for mounting RF transmitters on these mobile information handling systems. Within the information handling system, suitable locations for these RF systems and antennas besides the A-cover and B-covers are sought. This may lead to placing the RF systems and antennas in the C-cover or D-cover of the information handling systems.

Another consequence of using metal covers is the excitation of the metal surfaces of the covers described herein. This excitation of the metal surfaces leads to destructive interference in the signals sent by the antenna. Thus, a streamlined, full metal chassis capable of meeting the increasing wireless operation demands is needed.

Some information handling systems, would address these competing needs by providing for cutout portions of a metal outer chassis cover filled with plastic behind which RF transmitters/receivers would be mounted. The cutouts to accommodate radio frequency (RF) transmitters/receivers are often located in aesthetically undesirable locations and require additional plastic components to cover the cutout, thus not fully meeting the streamlining needs. The plastic components may add a component to be manufactured and can be required to be seamlessly integrated into an otherwise smooth metal chassis cover to achieve a level of aesthetics. Further, the plastic portions included may be expensive to machine, and may require intricate multi-step processes for integrating the metal and plastic parts into a single chassis. This requirement could require difficult and expensive processes to manufacture with a less aesthetically desirable result. Other options include, for aperture type antenna transmitters, creation of an aperture in the metal display panel chassis or base chassis and using the metal chassis as a ground plane for excitation of the aperture.

In addition, in the case of the convertible laptop information handling system, 360-degree configurability may be a feature available to a user during use. Thus, often an antenna such as an aperture antenna system would be located at the top (e.g., A-cover) with a plastic antenna window in a metal chassis cover to radiate in 360-degree mode (such as closed mode), or at the bottom (e.g., C-cover) to radiate in 360-degree mode (such as open mode). Such a configuration could make the display panel housing (e.g., A-cover) or even the base panel housing (e.g., C-cover) thicker, to accommodate antennas and cables behind the plastic panel at the top (or bottom) of either housing. Overall, an addition of a plastic antenna window in an A-cover or C-cover may not meet the streamlining needs. A solution is needed that does not increase the thickness of the metal chassis, and does not require additional components and manufacturing steps such as those associated with installation of extra RF transparent windows to break up the metal chassis in evident locations.

The metal chassis in embodiments described herein may include a hinge operably connecting the A-cover to the D-cover such that the keyboard and touchpad enclosed within the C-cover and attached to the D-cover may be placed in a plurality of configurations with respect to the digital display enclosed within the B-cover and attached to the A-cover. The plurality of configurations may include, but may not be limited to, an open configuration in which the A-cover is oriented at a right or obtuse angle from the D-cover (similar to an open laptop computer) and a closed configuration in which the A-cover lies substantially parallel to the D-cover (similar to a closed laptop computer), or other orientations.

Manufacture of embodiments of the present disclosure may involve fewer extraneous parts than previous chassis by forming the exterior or outer portions of the information handling system, including the bottom portion of the D-cover and the top portion of the A-cover, from metal in some embodiments.

Examples are set forth below with respect to particular aspects of an information handling system including case portions such as for a laptop information handling system including the chassis components designed with a fully metal structure and configurable such that the information handling system may operate in any of several usage mode configurations.

FIG. 1 shows an information handling system 100 capable of administering each of the specific embodiments of the present disclosure. The information handling system 100, in, an embodiment, can represent the mobile information handling systems 210, 220, and 230 or servers or systems located anywhere within network 200 described in connection with FIG. 2 herein, including the remote data centers operating virtual machine applications. Information handling system 100 may represent a mobile information handling system associated with a user or recipient of intended wireless communication. A mobile information handling system may execute instructions via a processor such as a microcontroller unit (MCU) operating both firmware instructions or hardwired instructions for the antenna adaptation controller 134 to achieve WLAN or WWAN antenna optimization according to embodiments disclosed herein. The application programs operating on the information handling system 100 may communicate or otherwise operate via concurrent wireless links, individual wireless links, or combinations over any available radio access technology (RAT) protocols including WLAN protocols. These application programs may operate in some example embodiments as software, in whole or in part, on an information handling system while other portions of the software applications may operate on remote server systems. The antenna adaptation controller 134 of the presently disclosed embodiments may operate as firmware or hardwired circuitry or any combination on controllers or processors within the information handing system 100 for interface with components of a wireless interface system 120. It is understood that some aspects of the antenna adaptation controller 134 described herein may interface or operate as software or via other controllers associated with the wireless interface system 120 or elsewhere within information handling system 100.

Information handling system 100 may also represent a networked server or other system from which some, software applications are administered or which wireless communications such as across WLAN or WWAN may be conducted. In other aspects, networked servers or systems may operate the antenna adaptation controller 134 for use with a wireless interface system 120 on those devices similar to embodiments for WLAN or WWAN antenna optimization operation according to according to various embodiments.

The information handling system 100 may include a processor 102 such as a central processing unit (CPU), a graphics processing unit (GPU) or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, or a solid-state display. Display 110 may include a touch screen display module and touch screen controller (not shown) for receiving user inputs to the information handling system 100. Touch screen display module may detect touch or proximity to a display screen by detecting capacitance changes in the display screen. Additionally, the information handling system 100 may include an input device 112, such as a keyboard, and a cursor control device, such as a mouse or touchpad or similar peripheral input device. The information handling system may include a power source such as battery 114 or an NC power source. The information handling system 100 can also include a disk drive unit 116, and a signal generation device. 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a wearable computing device, or a mobile smart phone.

The information handling system 100 can include sets of instructions 124 that can be executed to cause the Computer system to perform any one or more desired operations. In many aspects, sets of instructions 124 may implement wireless communications via one or more antenna systems 132 available on information handling system 100. In embodiments presented herein, the sets of instructions 124 may implement wireless communications via one or more antenna systems 132 formed within a C-cover or a D-Cover of a laptop-type information handling system. Operation of WLAN and WWAN wireless communications may be enhanced or otherwise improved via WLAN or WWAN antenna operation adjustments via the methods or controller-based functions relating to the antenna adaptation controller 134 disclosed herein. For example, instructions or a controller may execute software or firmware applications or algorithms which utilize one or more wireless links for wireless communications via the wireless interface system as well as other aspects or components. The antenna adaptation controller 134 may execute instructions as disclosed herein for monitoring wireless link state information, information handling system configuration data, or other input data to generate channel estimation and determine antenna radiation patterns. In the embodiments presented herein, the antenna adaptation controller 134 may execute instructions as disclosed herein to transmit a communications signal from an antenna system that is excited to resonant a target frequency at a slot formed in the D-Cover to transmit an electromagnetic wave at the target frequency or harmonics thereof. The term "antenna system" described herein is meant to be understood as any object that emits a RF electromagnetic (EM) wave therefrom.

In the embodiments presented herein, the antenna adaptation controller 134 may execute instructions as disclosed herein to adjust, via a parasitic coupling element, change the directionality and/or pattern of the emitted RF signals from the antenna. In various embodiments of the disclosure the parasitic coupling element includes a reflector network.

The antenna adaptation controller 134 may implement adjustments to wireless antenna systems and resources via an antenna front end 125 and WLAN or WWAN radio module systems within the wireless interface system 120. The antenna adaptation controller 134, in an embodiment, may implement adjustments to wireless antenna systems that operate on frequencies related to those 5G networks (i.e., high frequency (HF) band, very high frequency (VHF) band, ultra-high frequency (VHF) band, L band, S band, C band, X band, Ku band, K band, Ka band, V band, W band, and millimeter wave bands). Aspects of the antenna optimization for the antenna adaptation controller 134 may be included as part of an antenna front end 125 in some aspects or may be included with other aspects of the wireless interface system 120 such as WLAN radio module such as part of the radio frequency (RF) subsystems 130. The antenna adaptation controller 134 described in the present disclosure and operating as firmware or hardware (or in some parts software) may remedy or adjust one or more of a plurality of antenna systems 132 via selecting power adjustments and adjustments to an antenna adaptation network to modify antenna radiation patterns, an antenna element, and any parasitic coupling element operations in various embodiments.

In various embodiments, the adjustments are controlled via a smart antenna control system 140. In various embodiments, the smart antenna control system 140 includes one or more of a dynamic antenna configuration module 142 and an antenna power control module 144. In various embodiments, at least one of the plurality of antenna systems 132 comprises a smart antenna. As used herein a smart antenna comprises an antenna system having at least one configurable aspect (i.e., an antenna system where at least one antenna parameter associated with the antenna system is dynamically configurable). In various embodiments, the smart antenna control system 140 controls configuration of the configurable aspect of an antenna system 132 based upon the information regarding the configurable aspect of the smart antenna. In various embodiments, the configurable aspect comprises at least one of a configurable antenna feature and an antenna power configuration. In various embodiments, the antenna power configuration comprises at least one of a dual band simultaneous power configuration and an antenna power state configuration. In various embodiments, the dynamic antenna configuration module 142 controls configuration of the configurable antenna feature. In various embodiments, the antenna power control module 144 controls configuration of the antenna power configuration.

Multiple WLAN or WWAN antenna systems may operate on various communication frequency bands such as under IEEE 802.11a and IEEE 802.11g (i.e., medium frequency (MF) band, high frequency (HF) band, very high frequency (VHF) band, ultra-high frequency (VHF) band, L band, S band, C band, X band, $K_u$ band, K band, $K_a$ band, V band, W band, and millimeter wave bands) providing multiple band options for frequency channels. In some embodiments, the antenna systems may operate as 5G networks that implement relatively higher data transfer wavelengths such as high frequency (HF) band, very high frequency (VHF) band, ultra-high frequency (VHF) band, L hand, S band, C band, X band, Ku band, K band, Ka band, V band, W band, and millimeter wave bands. Further antenna radiation patterns and selection of antenna options or power levels may be adapted due physical proximity of other antenna systems, of a user with potential SAR exposure, or improvement of RF channel operation according to received signal strength indicator (RSSI), signal to noise ratio (SNR), bit error rate (BER), modulation and coding scheme index values (MCS), or data throughput indications among other factors. In some aspects WWAN or WLAN antenna adaptation controller may execute firmware algorithms or hardware to regulate operation of the one or more antenna systems 132 such as WWAN or WLAN antennas in the information handling system 100 to avoid poor wireless link performance due to poor reception, poor MCS levels of data bandwidth available, or poor indication of throughput due to indications of low RSSI, low power levels available (such as due to SAR), inefficient radiation patterns among other potential effects on wireless link channels used.

Various software modules comprising software instructions 124 or firmware instructions may be coordinated by an operating system (OS) and via an application programming interface (API). An example operating system may include Windows®, Android®, and other OS types known in the art. Example APIs may include Win 32®, Core Java® API, Android® APIs, or wireless adapter driver API. In a further example, processor 102 may conduct processing of mobile information handling system applications by the information handling system 100 according to the systems and methods disclosed herein which may utilize wireless communications. The computer system 100 may operate as a standalone device or may be connected such as using a network, to other computer systems or peripheral devices. In other aspects, additional processor or control logic may be implemented in graphical processor units (GPUs) or controllers located with radio modules or within a wireless adapter 120 to implement method embodiments of the antenna adaptation controller and antenna optimization according to embodiments herein. Code instructions 124 in firmware, hardware or some combination may be executed to implement operations of the antenna adaptation controller and antenna optimization on control logic or processor systems within the wireless adapter 120 for example.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a PDA, a mobile information handling system, a tablet computer, a laptop computer, a desktop computer, a communications device, a wireless smart phone, wearable computing devices, a control system, a camera, a scanner, a printer, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions 124. The disk drive unit 116 and static memory 106 also contain space for data storage. Some memory or storage may reside in the wireless adapter 120. Further, the instructions 124 may embody one or more of the methods or logic as described herein. For example, instructions relating to the WWAN or WLAN antenna adaptation system or antenna adjustments described in embodiments herein may be stored here or transmitted to local memory located with the antenna adaptation controller 134, antenna front end 125, or wireless module in RF subsystem 130 in the wireless interface system 120.

In a particular embodiment, the instructions 124 may reside completely, or at least partially, within a memory, such as non-volatile static memory, during execution of antenna adaptation by the antenna adaptation controller 134 in wireless interface system 132 of information handling system 100. As explained, some or all of the WWAN or WLAN antenna adaptation and antenna optimization may be executed locally at the antenna adaptation controller 134, antenna front end 125, or wireless module subsystem 130. Some aspects may operate remotely among those portions of the wireless interface system or with the main memory 104 and the processor 102 in parts including the computer-readable media in some embodiments.

Battery 114 may be operatively coupled to a power management unit that tracks and provides power state data 126. This power state data 126 may be stored with the instructions 124 to be used with the systems and methods disclosed herein in determining WWAN or WLAN antenna adaptation and antenna optimization in some embodiments.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more RF subsystems 130 with transmitter/receiver circuitry, modem circuitry, one or more unified antenna front end circuits 125, one or more wireless controller circuits such as antenna adaptation controller 134, amplifiers, antenna systems 132 and other radio frequency (RF) subsystem circuitry 130 for wireless communications via multiple radio access technologies. Each RF subsystem 130 may communicate with one or more wireless technology protocols. The RF subsystem 130 may contain individual subscriber identity module (SIM) profiles for each technology service provider and their available protocols for subscriber-based radio access technologies such as cellular LTE communications. The wireless adapter 120 may also include antenna systems 132 which may be tunable antenna systems or may include an antenna adaptation network for use with the system and methods disclosed herein to optimize antenna system operation. Additional antenna system adaptation network circuitry (not shown) may also be included with the wireless interface system 120 to implement WLAN or WWAN modification measures as described in various embodiments of the present disclosure.

In some aspects of the present disclosure, a wireless adapter 120 may operate two or more wireless links. In a further aspect, the wireless adapter 120 may operate the two or more wireless links with a single, shared communication frequency band such as with the Wi-Fi WLAN operation or 5G LTE standard WWAN operations in an example aspect. For example, a 5 GHz wireless communication frequency band may be apportioned under the 5G standards for communication on either small-cell WWAN wireless link operation or Wi-Fi WLAN operation as well as other wireless activity in LTE, WiFi, WiGig, Bluetooth, or other communication protocols. In some embodiments, the shared, wireless communication bands may be transmitted through one or a plurality of antennas. Other communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands. The plurality of wireless adapters 120 may further operate in nearby wireless communication bands in some disclosed embodiments. Further, harmonics, environmental wireless conditions, and other effects may impact wireless link operation when a plurality of wireless links are operating as in some of the presently described embodiments. The series of potential effects on wireless link operation may cause an assessment of the wireless adapters 120 to potentially make antenna system adjustments according to the WWAN or WLAN antenna adaptation control system of the present disclosure.

The wireless adapter 120 may operate in accordance with any wireless data communication standards. To communicate with a wireless local area network, standards including institute of Electrical and Electronics Engineers (IEEE) 802.11 wireless local area network (WLAN) standards, IEEE 802.15 wireless personal area network (WPAN) standards, wireless wide area network (WWAN) such as $3^{rd}$ Generation Partnership Project (3GPP) or $3^{rd}$ Generation Partnership Project 2 (3GPP2), or similar wireless standards may be used. Wireless adapter 120 and antenna adaptation controller 134 may connect to any combination of macro-cellular wireless connections including $2^{nd}$ Generation (2G), $2.5^{th}$ Generation (2.5G), $3^{rd}$ Generation (3G), $4^{th}$ Generation (4G), $5^{th}$ Generation (5G) or the like from one or more service providers. Utilization of RF communication bands according to several example embodiments of the present disclosure may include bands used with the WLAN standards and WWAN carriers which may operate in both license and unlicensed spectrums. For example, both WLAN and WWAN may use the Unlicensed National Information Infrastructure (U-NII) band which typically operates in the ~5 MHz frequency band, such as 802.11 a/h/j/n/ac/ax (e.g., having center frequencies between 5.170-7.125 GHz). It is understood that any number of available channels may be available under the 5 GHz shared communication frequency band in example embodiments. WLAN, for example, may also operate at a 2.4 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless RF communication capabilities as well as licensed wireless RF communication capabilities. For example, licensed wireless RF communication capabilities may be available via a subscriber carrier wireless service. With the licensed wireless RF communication capability, WWAN RF front end may operate on a licensed WWAN wireless radio with authorization for subscriber access to a wireless service provider on a carrier licensed frequency band. With the advent of 5G networks, any number of protocols may be implemented including global system for mobile communications (GSM) protocols, general packet radio service (GPRS) protocols, enhanced data rates for GSM evolution (EDGE) protocols, code-division multiple access (CDMA) protocols, universal mobile telecommunications system (UMTS) protocols, long term evolution (LTE) protocols, long term evolution advanced (LTE-A) protocols, WiMAX, LTE, and LTE Advanced, LTE-LAA, small cell WWAN and IP multimedia core network subsystem (IMS) protocols, for example, and any other communications protocols suitable for the method(s), system(s) and device(s) described herein, including any proprietary protocols.

The wireless adapter 120 can represent an add-in card, wireless network interface module that is integrated with a main board of the information handling system or integrated with another wireless network interface capability, or any combination thereof. In an embodiment the wireless adapter 120 may include one or more RF subsystems 130 including transmitters and wireless controllers such as wireless module subsystems for connecting via a multitude of wireless links under a variety of protocols. In an example embodiment, an information handling system may have an antenna system transmitter 132 for 5G small cell WWAN, Wi-Fi WLAN or WiGig connectivity and one or more additional antenna system transmitters 132 for macro-cellular communication. The RF subsystems 130 include wireless controllers to manage authentication, connectivity, communications, power levels for transmission, buffering, error correction, baseband processing, and other functions of the wireless adapter 120.

The RF subsystems 130 of the wireless adapters may also measure various metrics relating to wireless communication pursuant to operation of an antenna system as in the present disclosure. For example, the wireless controller of a RF subsystem 130 may manage detecting and measuring received signal strength levels, bit error rates, signal to noise ratios, latencies, power delay profile, delay spread, and other metrics relating to signal quality and strength. Such detected and measured aspects of wireless links, such as WWAN or WLAN links operating on one or more antenna systems 132, may be used by the antenna adaptation controller to adapt the antenna systems 132 according to an antenna adaptation network according to various embodiments herein. In one embodiment, a wireless controller of a wireless interface system 120 may manage one or more RF subsystems 130. The wireless controller also manages transmission power levels which directly affect RF subsystem power consumption as well as transmission power levels from the plurality of antenna systems 132. The transmission power levels from the antenna systems 132 may be relevant to specific absorption rate (SAR) safety limitations for transmitting mobile information handling systems. To control and measure power consumption via a RF subsystem 130, the RF subsystem 130 may control and measure current and voltage power that is directed to operate one or more antenna systems 132.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionalities as described therein.

The present disclosure contemplates a computer-readable medium that includes instructions 124 or receives and executes instructions 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs, and Basic Input/Output System and firmware (BIOS/FW) code. BIOS/FW code functions to initialize information handling system 100 on power up, to launch an operating system, and to manage input and output interactions between the operating system and the other elements of information handling system 100. In a particular embodiment, BIOS/FW code reside in memory 104, and include machine-executable code that is executed by processor 102 to perform various functions of information handling system 100. In another embodiment (not illustrated), application programs and BIOS/FW code may reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

While the computer-readable medium is shown to be a single medium, the term "computes-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2:
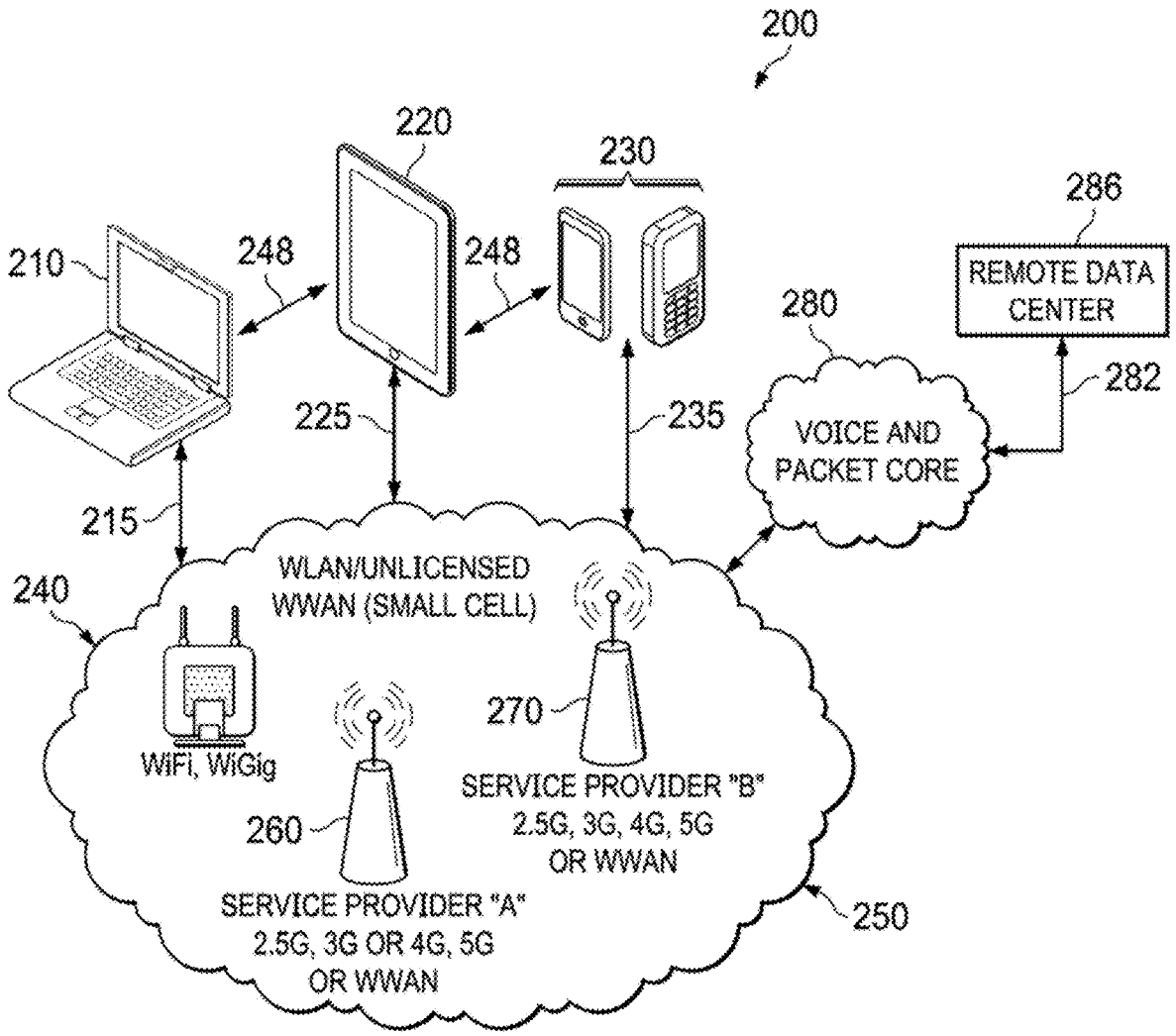
FIG. 2 shows a block diagram of a network environment offering several communication protocol options and mobile information handling systems according to an embodiment of the present disclosure.

FIG. 2 shows a network 200 that can include one or more information handling systems 210, 220, 230. In a particular embodiment, network 200 includes networked mobile information handling systems 210, 220 and 230, wireless network access points, and multiple wireless connection link options. A variety of additional computing resources of network 200 may include client mobile information handling systems, data processing servers, network storage devices, local and wide area networks, or other resources as needed or desired. As partially depicted, systems 210, 220, and 230 may be a laptop computer, tablet computer, 360-degree convertible systems, wearable computing devices, or a smart phone device. These mobile information handling systems 210, 220, and 230, may access a wireless local network 240, or they may access a macro-cellular network 250. For example, the wireless local network 240 may be the wireless local area network (WLAN), a wireless personal area network (WPAN), or a wireless wide area network (WWAN), in an example embodiment, LTE-LAA WWAN may operate with a small-cell WWAN wireless access point option.

Since WPAN or Wi-Fi Direct Connection 248 and WWAN networks can functionally operate similar to WLANs, they may be considered as wireless local area networks (WLANs) for purposes herein. Components of a WEAN may be connected by wireline or Ethernet connections to a wider external network. For example, wireless network access points may be connected to a wireless network controller and an Ethernet switch, Wireless communications across wireless local network 240 may be via standard protocols such as IEEE 802.11 Wi-Fi, IEEE 802.11ad WiGig, IEEE 802.15 WPAN, IEEE 802.11, IEEE 1914/1904, IEEE P2413/1471/42010, or 5G small cell WWAN communications such as eNodeB, or similar wireless network protocols. Alternatively, other available wireless links within network 200 may include macro-cellular connections 250 via one or more service providers 260 and 270. Service provider macro-cellular connections may include 2G standards such as GSM, 2.5G standards such as GSM EDGE and GPRS, 3G standards such as W-CDMA/UMTS and CDMA 2000, 4G standards, or 5G standards including GSM, GPRS, EDGE, UMTS, IMS, WiMAX, LTE, and LTE Advanced, LTE-LAA, small cell WWAN, and the like.

Wireless local network 240 and macro-cellular network 250 may include a variety of licensed, unlicensed or shared communication frequency bands as well as a variety of wireless protocol technologies ranging from those operating in macrocells, small cells, picocells, or femtocells.

In some embodiments according to the present disclosure, a networked mobile information handling system 210, 220, or 230 may have a plurality of wireless network interface systems capable of transmitting simultaneously within a shared communication frequency band. That communication within a shared communication frequency band may be sourced from different protocols on parallel wireless network interface systems or from a single wireless network interface system capable of transmitting and receiving from multiple protocols. Similarly, a single antenna or plural antennas may be used on each of the wireless communication devices. Example competing protocols may be local wireless network access protocols such as Wi-Fi/WLAN, WiGig, and small cell WWAN in an unlicensed, shared communication frequency band. Example communication frequency bands may include unlicensed 5 GHz frequency bands or 3.5 GHz conditional shared communication frequency bands under FCC Part 96. Wi-Fi ISM frequency bands that may be subject to sharing include 2.4 GHz, 70 GHz, 900 MHz or similar bands as understood by those of skill in the art. Within local portion of wireless network 250 access points for Wi-Fi car WiGig as well as small cell WWAN connectivity may be available in emerging 5G technology such as high frequency (HF) band, very high frequency (VHF) band, ultra-high frequency (VHF) band, L band, S band, C band, X band, Ku band, K band, Ka band, V band, W band, and millimeter wave bands. This may create situations where a plurality of antenna systems are operating on a mobile information handling system 210, 220 or 230 via concurrent communication wireless links on both WLAN and WWAN and which may operate within the same, adjacent, or otherwise interfering communication frequency bands. The antenna may be a transmitting antenna that includes high-band, medium-band, low-band, and unlicensed band transmitting antennas. Alternatively, embodiments may include a single transceiving antenna capable of receiving and transmitting, and/or more than one transceiving antennas. Each of the antennas included in the information handling system 100 in an embodiment may be subject to the FCC regulations on specific absorption rate (SAR). The antenna in the embodiments described herein is an aperture antenna intended for efficient use of space within a metal chassis of an information handling system. Aperture antennas in embodiments of the present disclosure may be an effective improvement on wireless antennas employed in previous information handling systems.

The voice and packet core network 280 may contain externally accessible computing resources and connect to a remote data center 286. The voice, and packet core network 280 may contain multiple intermediate web servers or other locations with accessible data (not shown). The voice and packet core network 280 may also connect to other wireless networks similar to 240 or 250 and additional mobile information handling systems such as 210, 220, 230 or similar connected to those additional wireless networks. Connection 282 between the wireless network 240 and remote data center 286 or connection to other additional wireless networks may be via Ethernet or another similar connection to the world-wide-web, a WAN, a LAN, another WLAN, or other network structure. Such a connection 282 may be made via to WLAN access point/Ethernet switch to the external network and be a backhaul connection. The access point may be connected to one or more wireless access points in the WLAN before connecting directly to a mobile information handling system or may connect directly to one or more mobile information handling systems 210, 220, and 230. Alternatively, mobile information handling systems 210, 220, and 230 may connect to the external network via base station locations at service providers such as 260 and 270. These service provider locations may be network connected via backhaul connectivity through the voice and packet core network 280.

Remote data centers may include web servers or resources within a cloud environment that operate via the voice and packet core 280 or other wider internet connectivity. For example, remote data centers can include additional information handling systems, data processing servers, network storage devices, local and wide area networks, or other resources as needed or desired. Having such remote capabilities may permit fewer resources to be maintained at the mobile information handling systems 210, 220, and 230 allowing streamlining and efficiency within those devices. Similarly, remote data center permits fewer resources to be maintained in other parts of network 200.

Although 215, 225, and 235 are shown connecting wireless adapters of mobile information handling systems 210, 220, and 230 to wireless networks 240 or 250, a variety of wireless links are contemplated. Wireless communication may link through a wireless access point (Wi-Fi or WiGig), through unlicensed WWAN small cell base stations such as in network 240 or through a service provider tower such as that shown with service provider A 260 or service provider B 270 and in network 250. In other aspects, mobile information handling systems 210, 220, and 230 may communicate intra-device via 248 when one or more of the mobile information handling systems 210, 220, and 230 are set to act as an access point or even potentially a WWAN connection via small cell communication on licensed or unlicensed WWAN connections. For example, one of mobile information handling systems 210, 220, and 230 may serve as a Wi-Fi hotspot in an embodiment. Concurrent wireless links to information handling: systems 210, 220, and 230 may be connected via any access points including other mobile information handling systems as illustrated in FIG. 2.

Figure 3:
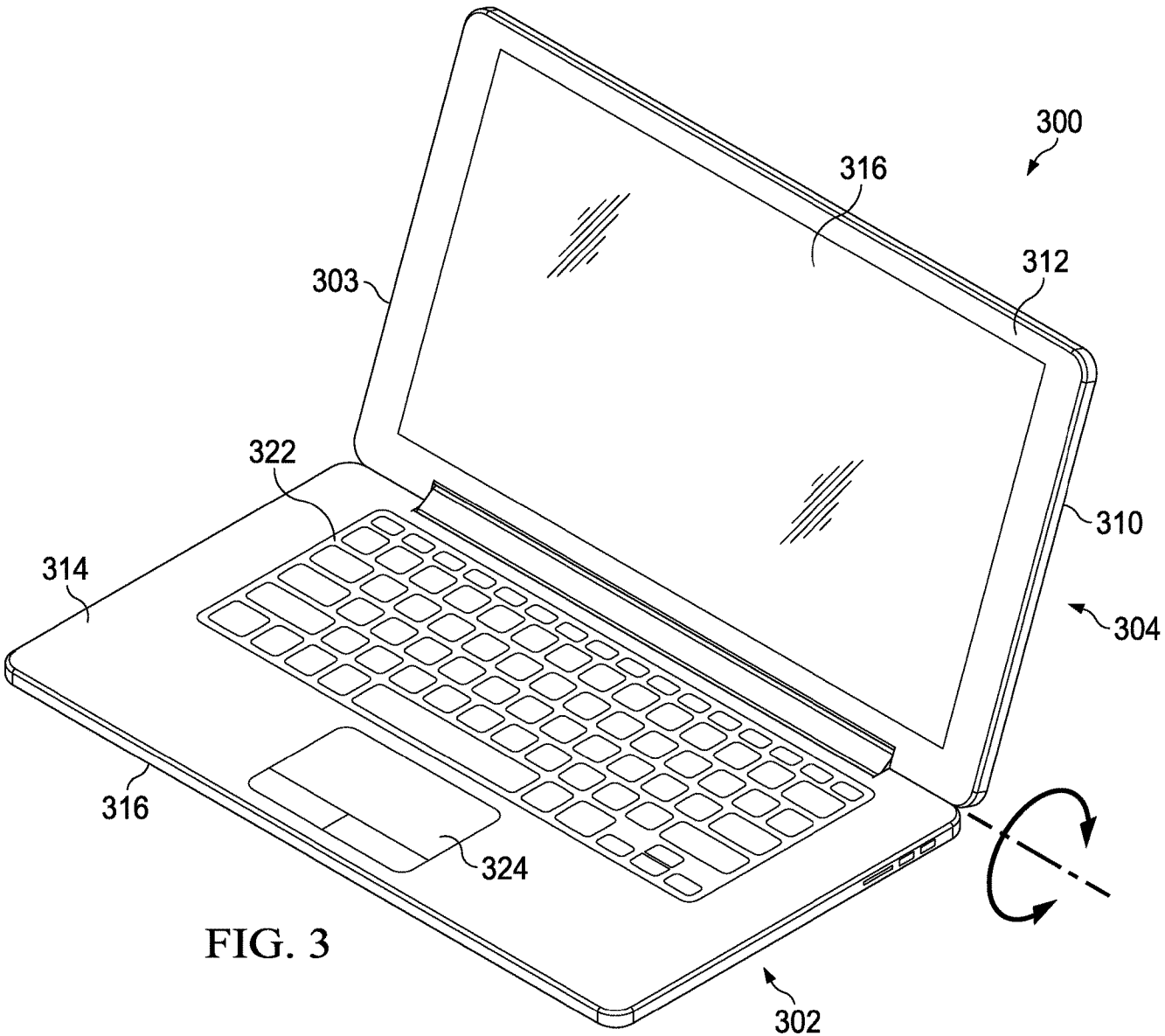
FIG. 3 shows a graphical illustration of an information handling system placed in an open configuration according to an embodiment of the present disclosure.

FIG. 3 shows a perspective view of an example portable information handling system 300 such as a tablet type portable information handling system, a laptop type portable information handling system, or any other mobile information handling system. The portable information handling system 300 includes a base chassis 302 and display chassis 304 shown in an open configuration. It will be appreciated that a closed configuration would have the display chassis 304 fully closed, onto the base chassis 302.

The base chassis or the display chassis of the information handling system 300 may comprise an outer metal case or shell. The information handling system 300 may include a plurality of chassis portions. In various embodiments, the information handling system 300 may include some or all of an A-Cover 310, a B-Cover 312, a C-cover 314 and a D-Cover 316. In various embodiments, the A-Cover 310 and the B-Cover 312 provide the display chassis 304. In various embodiments, the C-Cover 314 and the D-Cover 316 provide the base chassis 302.

In various embodiments, the A-cover 310 encloses a portion of the display chassis 304 of the information handling system 300. In various embodiments, the B-cover encloses another portion of the display chassis 304 of the information handling system 300. In various embodiments, the B-Cover may include a display screen and a bezel 303 around the display screen.

In various embodiments, the C-cover 314 encloses a portion of the base chassis 302 of the information handling system 300. In various embodiments, the C-cover 314 may include, for example, a keyboard 322, a trackpad 324, or other input/output (I/O) device. In various embodiments, components of the information handling system such as a mother board are mounted within the C-Cover 314. In various embodiments, the D-cover 316 encloses another portion of the base chassis 302 of the information handling system 300.

When placed in the closed configuration, the A-cover 310 forms a top outer protective shell, or a portion of a lid, for the information handling system 300, while the D-cover 304 forms a bottom outer protective shell, or a portion of a base, for the information handling system. When in the fully closed configuration, the A-cover 310 and the D-cover 316 would be substantially parallel to one another.

In some embodiments, both the A-cover 310 and the D-cover 316 may be comprised entirely of metal. In some embodiments, the A-cover 310 and D-cover 316 may include both metallic and plastic components. For example, plastic components that are radio-frequency (RF) transparent may be used to form a portion of the C-cover 308.

In various embodiments, the A-cover 310 may be movably connected to a back edge of the D-cover 304 via one or more hinges. In this configuration the hinges allow the A-cover 310 to rotate from and to the D-cover 316 allowing for multiple orientations of the information handling system 300. In various embodiments, the information handling system may include a sensor to detect the orientation of the information handling system and activate or deactivate any of a number of antenna systems based on the occurrence of any specific orientation. In some embodiments, the information handling system may be a laptop with limited rotation of the A-cover 310 with regard to the D-cover 316, for example up to 180° rotation arc. In other embodiments the information handling system 300 may be a convertible information handling system with full rotation to a tablet configuration.

Figure 4:
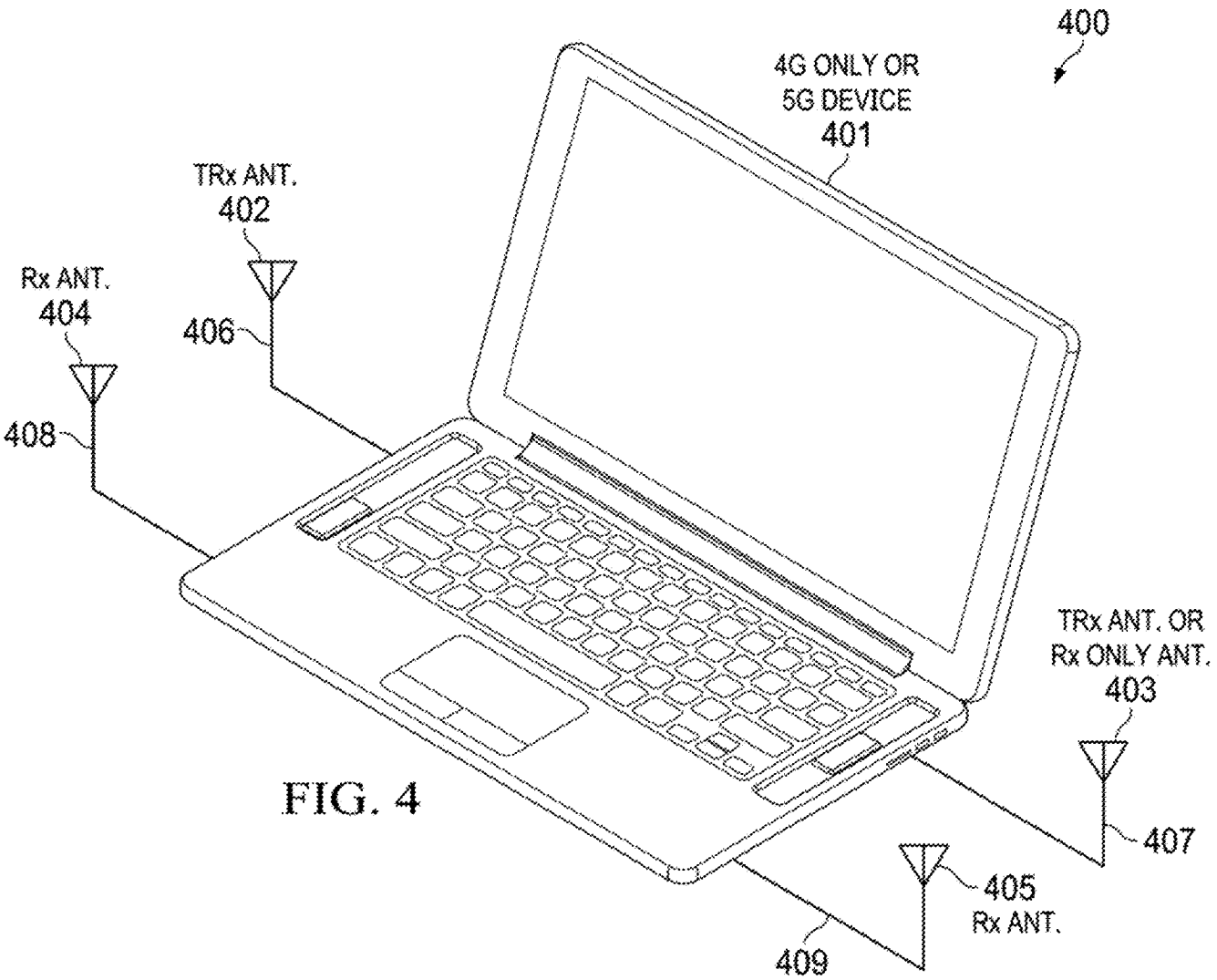
FIG. 4 shows a block diagram of an apparatus for providing a multiple antenna system architecture supporting multiple generations of radio modems according to an embodiment of the present disclosure.

FIG. 4 shows an apparatus for providing a multiple antenna system architecture supporting multiple generations of radio modems according to an embodiment of the present disclosure. Apparatus 400 includes information handling system 401 having multiple antennas, including at least one transmit and receive (transceiver) antenna and at least one receive-only antenna. Transmit and receive antenna 402 is coupled to information handling system 401 via interconnect 406. Antenna 403, which may be a transmit and receive antenna or a receive-only antenna, is coupled to information handling system 401 via interconnect 407. Receive-only antenna 404 is coupled to information handling system 401 via interconnect 408. Receive-only antenna 405 is coupled to information handling system 401 via interconnect 409. The same antenna configuration can be used for multiple generations (e.g., 4G and 5G) of cellular modems. Each antenna can be usable for any of the multiple generations of cellular modems.

Figure 5:
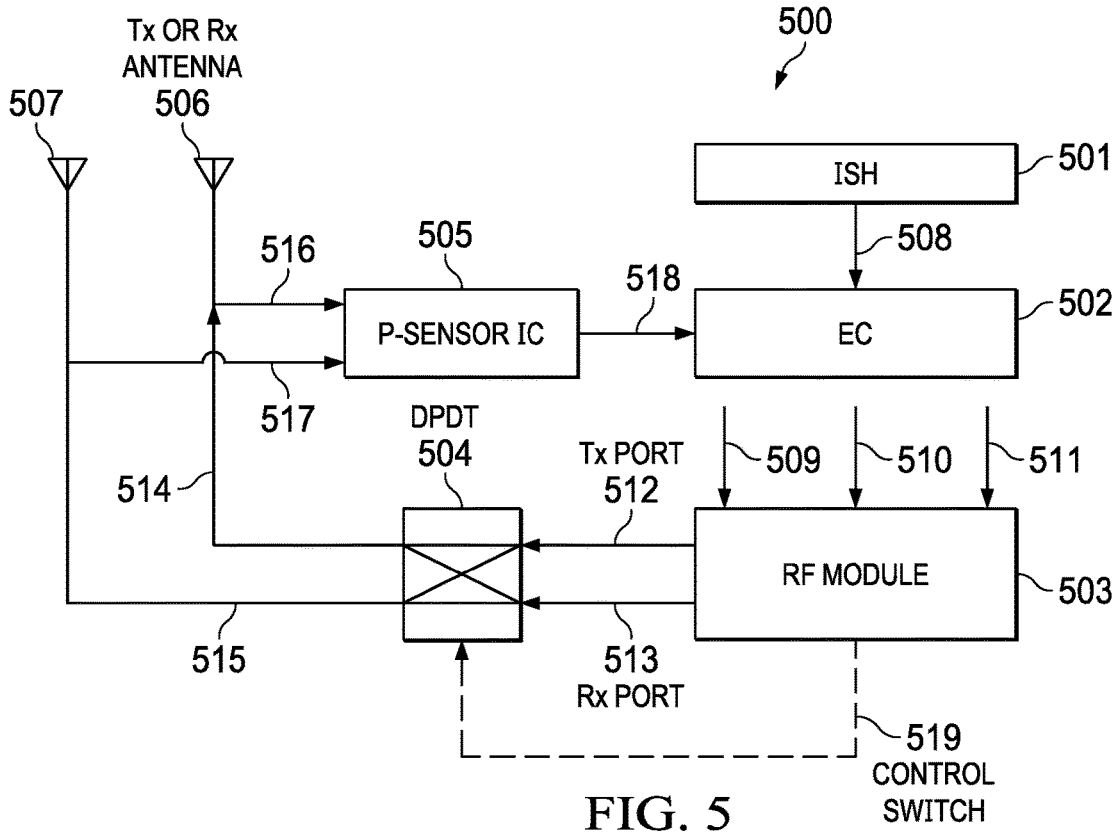
FIG. 5 shows a block diagram of a multiple antenna system according to an embodiment of the present disclosure.

FIG. 5 shows a block diagram of a multiple antenna system according to an embodiment of the present disclosure. Multiple antenna system 500 comprises integrated sensor hub (ISH) 501, embedded controller (EC) 502, radio frequency (RF) module 503, antenna switch 504, proximity sensor (P-sensor) integrated circuit (IC) 505, antenna 506, and antenna 507. ISH 501 provides information from sensors, which may include, for example, a hinge position sensor to indicate a position of a hinge connecting a base system side housing to a display panel housing, or, as another example, an orientation sensor (e.g., a tilt sensor) to indicate an orientation of at least one of the base system side housing and the display panel housing. Antenna 506 provides a proximity signal 516 to proximity sensor 505.

Antenna 507 provides a proximity signal 517 to proximity sensor 505. Proximity sensor 505 provides a proximity control signal 518 to EC 502.

Information provided by ISH 501 can include, for example, a mode indication representative of a physical configuration of ISH 501 to enclosure controller (EC) 502 via interconnect 508. EC 502 is a processor for controlling information handling system components within an enclosure of the information handling system, as opposed to a general-purpose processor for executing user applications. EC 502 provides control signals 509, 510, 511 to RF module 503. As an example, EC 502 can provide a mode indication signal representative of a device physical configuration (e.g., whether the device is in a device physical configuration corresponding to a notebook mode or a device physical configuration corresponding to a 360 mode) at interconnect 510.

RF module 503 receives the control signals. RF module logically operates on the control signals to produce a control switch signal 519 provided to antenna switch 504. As an example, antenna switch 504 may be of a double-pole double-throw (DPDT) configuration, allowing the connection of a transmission (TX) port of RF module 503 to either one of antennas 506 and 507 and connection of a reception (RX) port of RF module 503 to an opposite one of the antennas 506 and 507. Thus, in a first position, antenna switch 504 can connect the TX port to antenna 506 and the RX port to antenna 507, and, in a second position, antenna switch 504 can connect the TX port to antenna 507 and the RX port to antenna 506. The TX port of RF module 503 is connected to a TX port of antenna switch 504 via transmit signal interconnect 512.

The RX port of RF module 503 is connected to a RX port of antenna switch 504 via receive signal interconnect 513. A first antenna port of antenna switch 504 is connected to antenna 506 via antenna interconnect 514. A second antenna port of antenna switch 504 is connected to antenna 507 via antenna interconnect 515.

Figure 6:
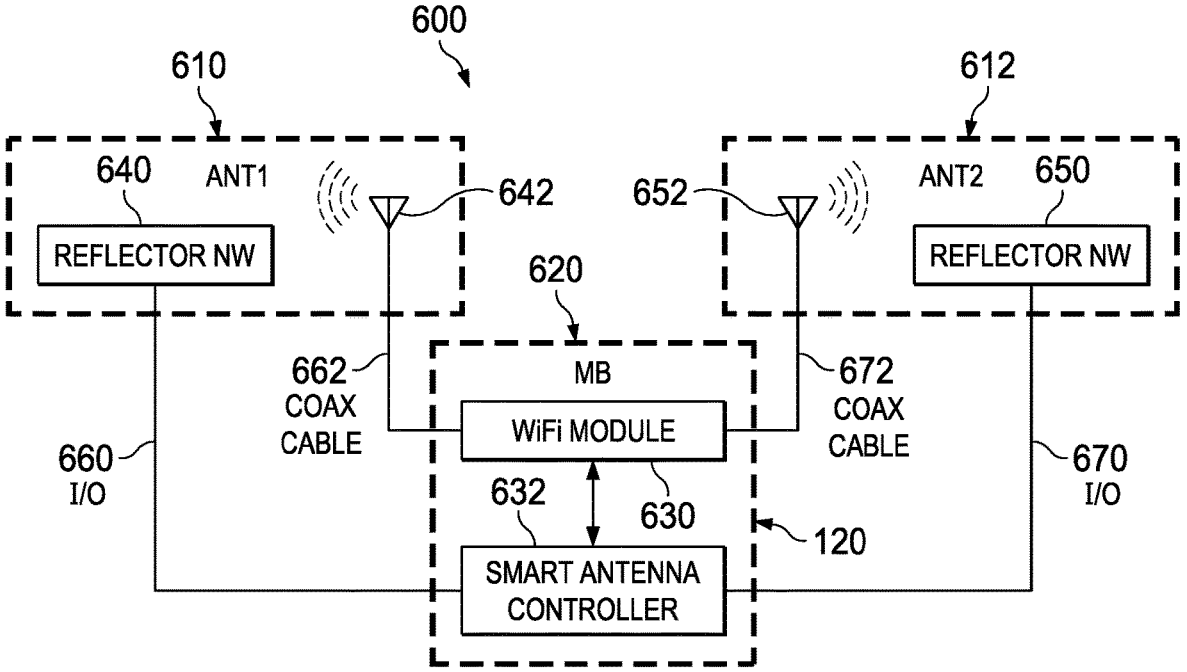
FIG. 6 shows a block diagram of a multiple antenna system according to an embodiment of the present disclosure.

FIG. 6 shows a block diagram of a multiple antenna system 600 according to an embodiment of the present disclosure. In various embodiments, the multiple antenna system 600 is configured as a 2.2 multiple input, multiple output (MIMO) system. For the purposes of this disclosure, a MIMO system is an antenna system for wireless communications in which multiple antennas are used as both the source (i.e., a transmitter) and a destination a receiver). In certain embodiments, the multiple antenna system 600 provides a technique for sending and receiving more than one data signal simultaneously over the same radio channel by exploiting multipath propagation.

In various embodiments, multiple antenna system 600 is included within wireless interface system 120. Multiple antenna system 600 includes a first antenna system (ANT1) 610, a second antenna system (ANT2) 612 and antenna control system 620. In various embodiments, first antenna system 61 and second antenna system 612 are included within antenna systems 132. In various embodiments, antenna control system 610 is included within components of wireless interface adapter 120.

In various embodiments, antenna control system 610 includes WiFi module 630 and smart antenna controller 632. In various embodiments, WiFi module 630 is included within radio frequency subsystem 130 and smart antenna controller 632 is included within antenna adaptation controller 134.

In various embodiments, first antenna system 610 includes reflector network 640 and antenna 642. In various embodiments, reflector network 640 is coupled to smart antenna controller 632 and antenna 642 is coupled to WiFi module 630. In various embodiments, reflector network 640 is coupled to smart antenna controller 632 via input/output signal path 660. In various embodiments, antenna 642 is coupled to WiFi module 630 via a coaxial cable 662. In various embodiments, the reflector network 650 includes a reflector element (also referred to as a reflector) which changes the current distribution of the antenna to create a phase shift generated to dynamically change the radiating pattern of the antenna. Changing the capacitance or inductance on the reflector network effectively adds a delay at the reflecting element so that the current distribution on the reflector element and the antenna is varied depending on the frequency that is being excited.

In various embodiments, second antenna system 612 includes reflector network 650 and antenna 652. In various embodiments, reflector network 650 is coupled to smart antenna controller 632 and antenna 652 is coupled to WiFi module 630. In various embodiments, reflector network 650 is coupled to smart antenna controller 632 via input/output signal path 670. In various embodiments, antenna 652 is coupled to WiFi module 630 via a coaxial cable 672. In various embodiments the second antenna system 612 is configured as a mirror image of the first antenna system 610. In various embodiments, the reflector network 650 includes a reflector element (also referred to as a reflector) to which an alternating current distribution is changed to create a phase shift is generated to dynamically change the reflecting pattern of the reflector element. This effectively adds a delay at the reflecting element so that the current distribution on the reflector element is varied depending on the frequency that is being excited.

In various embodiments, reflector network 640 and 650 reflect electromagnetic waves generated by antennas 642 and 652, respectively. In various embodiments reflector networks 640 and 650 redirect radio frequency energy. In various embodiments, reflector networks 640 and 650 are integrated within their respective antenna systems and modify the radiation pattern of their respective antennas, increasing gain in a predetermined direction. In various embodiments, the increased gain is directed through respective slots of the dual-slot antenna system.

In various embodiments, reflector network 642 and reflector network 652 may be independently made active (e.g., coupled to ground). In various embodiments, smart antenna controller 632 controls when each reflector network 642, 652 is activated. Accordingly, the patterns generated by first antenna system 610 and second antenna system 612 do not necessarily correlate. In certain embodiments, the patterns generated by the first antenna system 610 and second antenna system 612 are optimized for a respective chain of the 2×2 MIMO system.

Figure 7:
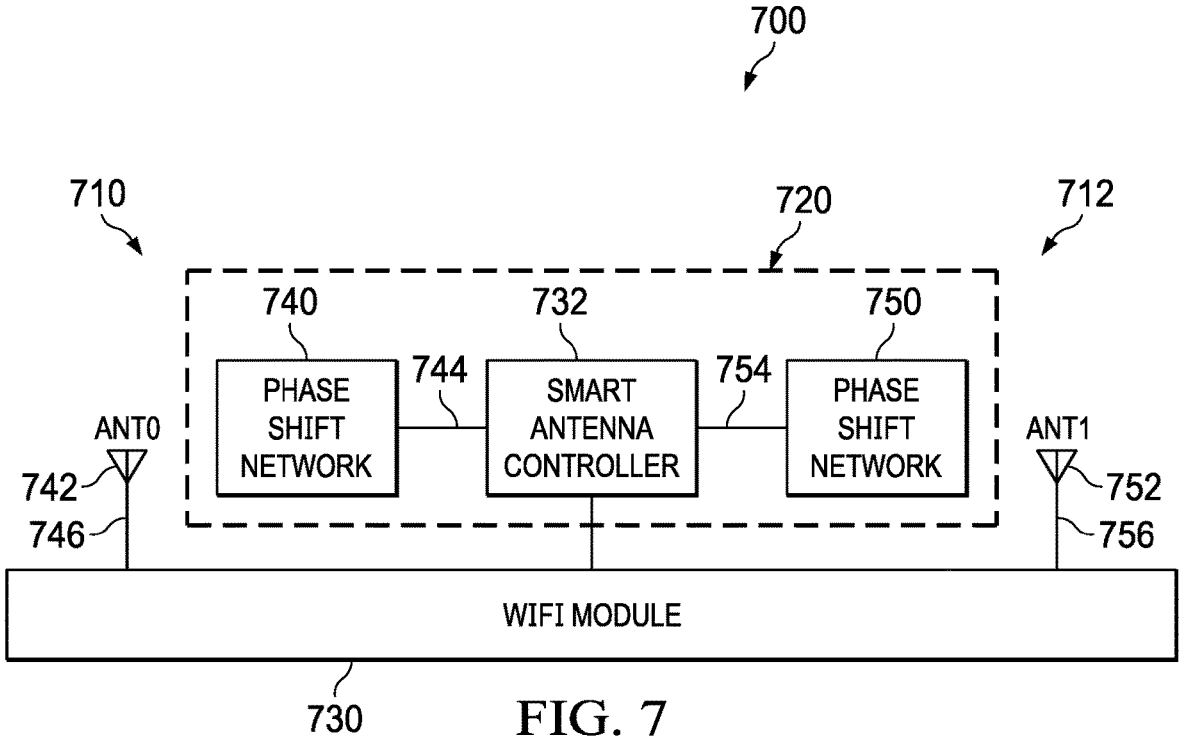
FIG. 7 shows a block diagram of a smart antenna system according to an embodiment of the present disclosure.

FIG. 7 shows a block diagram of a smart antenna system 700 according to an embodiment of the present disclosure. In various embodiments, the smart antenna system 700 is configured as a 2.2 multiple input, multiple output (MIMO) system. In certain embodiments, the smart antenna system 700 provides a technique for sending and receiving more than one data signal simultaneously over the same radio channel by exploiting multipath propagation.

In various embodiments, smart antenna system 700 is included within wireless interface system 120. Smart antenna system 700 includes a first antenna system (ANT0) 710, a second antenna system (ANT1) 712 and antenna control system 720. In various embodiments, first antenna system 710 and second antenna system 712 are included within antenna systems 132. In various embodiments, antenna control system 720 is included within components of wireless interface adapter 120.

In various embodiments, antenna control system 710 includes WiFi module 730 and smart antenna controller 732. In various embodiments, WiFi module 730 is included within radio frequency subsystem 130 and smart antenna controller 732 is included within antenna adaptation controller 134.

In various embodiments, first antenna system 710 includes phase shift network 740 and antenna 742. In various embodiments, phase shift network 740 is coupled to smart antenna controller 732 and antenna 742 is coupled to WiFi module 730. In various embodiments, phase shift network 740 is coupled to smart antenna controller 732 via input/output signal path 744. In various embodiments, antenna 742 is coupled to WiFi module 730 via a coaxial cable 746.

In various embodiments, second antenna system 712 includes phase shift network 750 and antenna 752. In various embodiments, phase shift network 750 is coupled to smart antenna controller 732 and antenna 752 is coupled to WiFi module 730. In various embodiments, phase shift network 750 is coupled to smart antenna controller 732 via input/output signal path 754. In various embodiments, antenna 752 is coupled to WiFi module 730 via a coaxial cable 756. In various embodiments the second antenna system 712 is configured as a mirror image of the first antenna system 710.

In various embodiments, phase shift networks 740 and 750 are controlled such that their states are altered by antenna controller 732 based on input from the Wifi access radio technology. Altering the state of the phase shift network 740, 750 changes the current distribution generated by antennas 742 and 752, respectively, and in turn alter the radiation pattern of each antenna. In various embodiments phase shift networks 740 and 750 redirect radio frequency energy. In various embodiments, phase shift networks 740 and 750 are integrated within their respective antenna systems and modify the radiation pattern of their respective antennas, increasing gain in a predetermined direction. In various embodiments, the increased gain is directed through respective slots of the dual-slot antenna system.

In various embodiments, phase shift network 742 and phase shift network 752 may be independently made active (e.g., when a state is selected for a particular phase shift network, the change to the state alters a pre-defined impedance matched network on the particular phase shift network, and thereby introduces a separate impedance match towards the antenna associated with the particular phase shift network. This impedance match alters the behavior of the current distribution around the antenna thereby introducing a change in the antenna pattern.). In various embodiments, smart antenna controller 732 controls when each phase shift network 740, 750 is activated. Accordingly, the patterns generated by first antenna system 710 and second antenna system 712 do not necessarily correlate. In certain embodiments, the patterns generated by the first antenna system 710 and second antenna system 712 are optimized for a respective chain of the 2×2 MIMO system.

Figure 8:
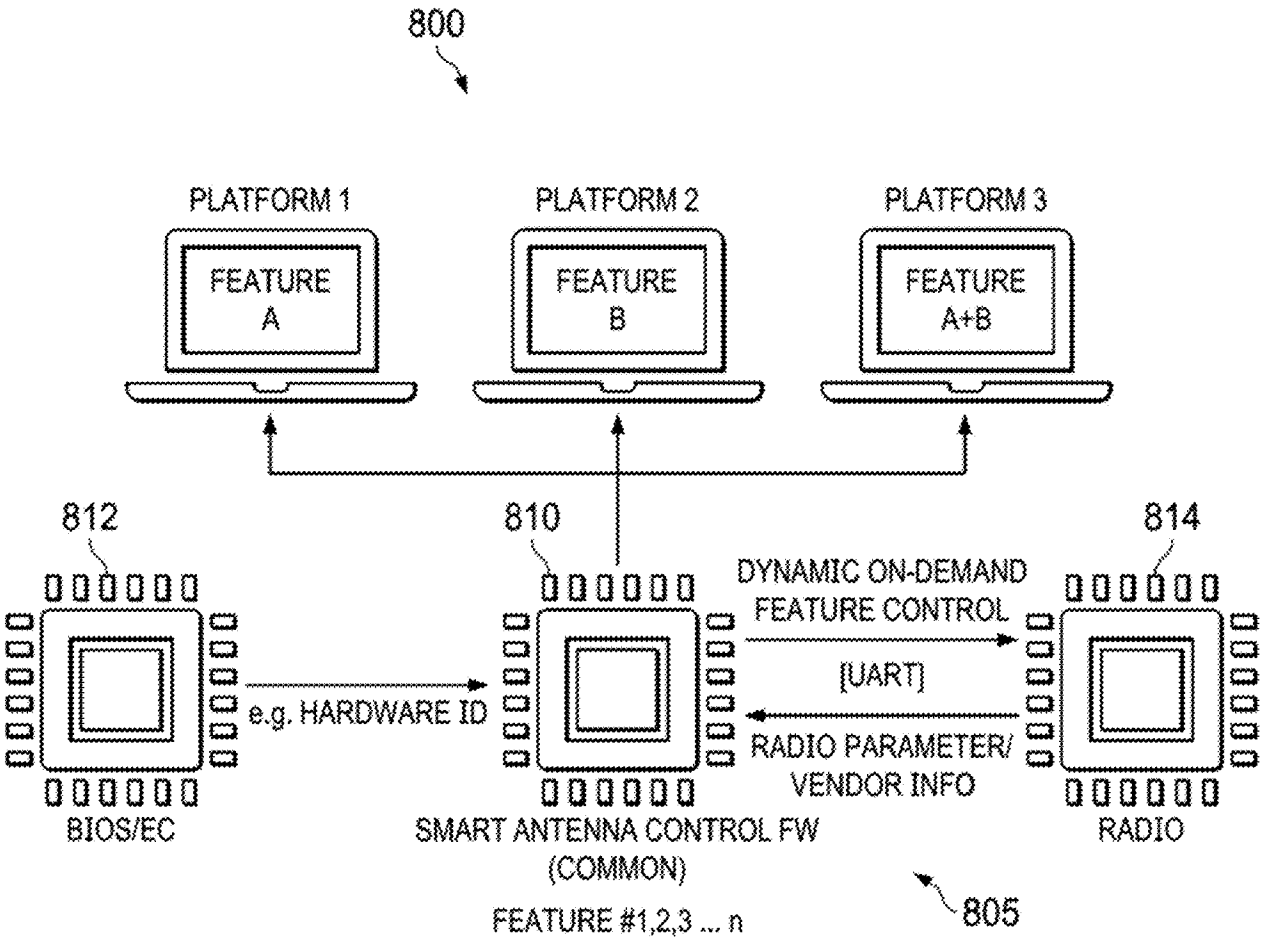
FIG. 8 shows a block diagram of a dynamic antenna configuration environment according to an embodiment of the present disclosure.

FIG. 8 shows a block diagram oft dynamic antenna configuration environment 800 according to an embodiment of the present disclosure. Various aspects of the present disclosure include an appreciation that a configurable smart antenna controller may be used to dynamically shift an antenna pattern via steerable network towards a stronger incoming signal, communicate to the radio to dynamically alter transmit power per antenna based on region, number of chains (e.g., 1×1 or 2×2), determine antenna tuning to support concurrent (2.4+5 GHz) or non-concurrent (2.4 or 5 GHz) radio transmissions dynamically based on incoming radio parameter, data to which controller is paired with and other antenna control features & platform configurations. Each of the antenna/radio parameters processed by the smart antenna controller is unique, for a given platform having to support multiple antenna stock keeping units (SKUs), radio SKUs (1×1/2×2/Concurrent/Non-Concurrent), region SKUs, technology SKUs (5G+WiFi or WiFi) or across platforms. Various aspects of the present disclosure include an appreciation that antenna controller firmware which is unique per SKU/Platform to create platform specific builds to support platform specific configuration and features, increases firmware development complexity that can be challenging to manage.

Accordingly, in various embodiments, a smart antenna controller 810 which is platform agnostic is provided to supports different platforms having different configuration needs and feature selection. In various embodiments, the smart antenna controller 810 includes a single firmware image that can by dynamically configured to identify platform specific configuration and feature selection. External control of the smart antenna controller 810 may be via a GPIO from system BIOS/EC for SKU detect, or payload from radio module containing radio parametric information such as a number of chains, bands, concurrent or non-concurrent transmissions, system sensor inputs triggering number of transmit antennas which can be used as run-time variables to dynamically configure the smart antenna controller 810.

More specifically, in various embodiments, a dynamic antenna configuration system 805 includes a smart antenna controller 810, a basic input output system/enclosure controller (BIOS/EC) portion 812 and a radio portion 814. In various embodiments, the smart antenna controller 810 includes smart antenna control firmware. In various embodiments the smart antenna controller 810 is included within antenna system controller 134. In various embodiments, the radio portion 810 is included within the radio frequency subsystems 130. In various embodiments, the smart antenna controller 810 communicates with the radio portion 814 via a universal asynchronous receive-transmitter (UART). In operation, the smart antenna controller 810 receives hardware identifier information from the BIOS/EC portion 812 and radio parameter and/or vendor information from the radio portion.

In various embodiments the dynamic antenna configuration environment 800 includes a plurality of information handling system platforms 820. In various embodiments, the smart antenna controller 810 controls a plurality of antenna features of a particular information handling system platform. In various embodiments, the plurality of antenna features include one or more of a number of antenna chains feature, an antenna transmit power feature, a number of antenna modes feature, a number of antenna device modes feature, a number of module vendors feature and a region feature. More specifically, the number of antenna chains feature controls whether the antenna system is configured as a 1×1 antenna system, a 2×2 antenna system as well as a number of MIMO chains of the antenna system. The antenna transmit power feature controls a maximum output power of the antenna system to assure federal communications commission (FCC) exposure compliance of the antenna system. The number of Antenna modes feature controls a radiation mode from a plurality of supported radiation modes of antenna. The number of module vendors feature identifies which one of a plurality of potential vendors provide the radio that is included within the information handling system. The regions feature controls in which one a plurality of regulatory regions (e.g., FCC, Conformite European (CE) etc.) the information handling system in which the antenna system is installed will be used, thus ensuring the antenna system complies with the regulations of that particular region.

The smart antenna controller 810 performs a dynamic, on-demand feature control operation. In various embodiments, the dynamic, on-demand feature control operation dynamically (i.e., as frequently as desired) controls one or more of the plurality of antenna features of a particular information handling system on an on-demand basis (i.e., whenever a change to a feature of the antenna system is desired).

Figure 9:
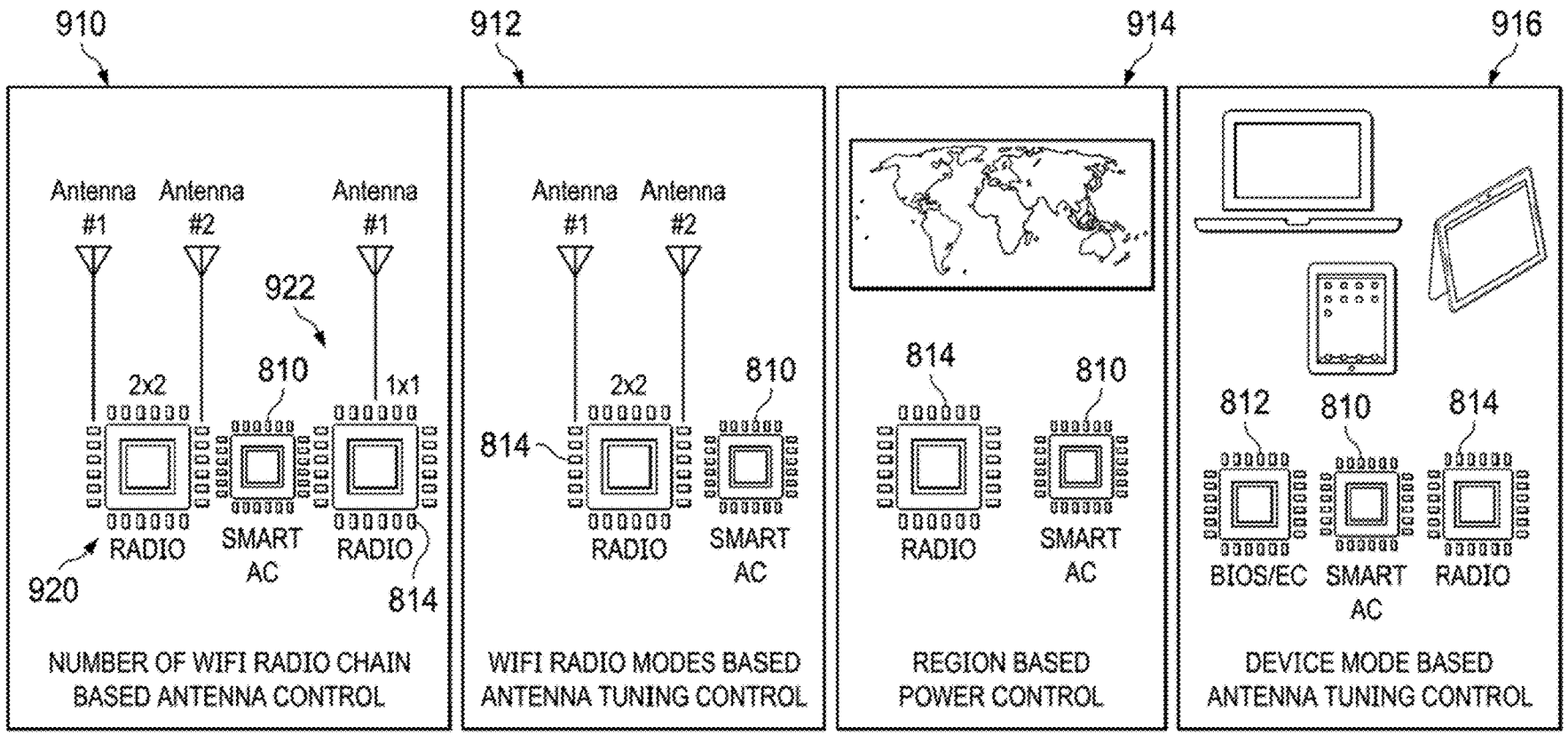
FIG. 9 shows a plurality of example antenna configurations of a dynamic antenna configuration environment according to an embodiment of the present disclosure.

FIG. 9 shows a plurality of example antenna configurations of a dynamic antenna configuration environment 800 according to an embodiment of the present disclosure. In various embodiments, the smart antenna controller 810 performs a number of WiFi radio antenna chains operation 910 which determines how many antennas with which the radio portion 814 communicates. In various embodiments, the smart antenna controller 810 controls whether a particular information handling system is configured to use a 1×1 antenna chain 922 or a 2×2 antenna chain 920. In various embodiments, the smart antenna controller 810 controls the number of antenna chains based upon a number of antenna chains value. In various embodiments, the smart antenna controller 810 controls how many antennas with which the radio portion 814 communicates via the number of antenna chains value.

In various embodiments, the smart antenna controller 810 performs a WiFi radio antenna modes operation 912 which determines a radio mode for one or more antennas of a particular information handling system. In various embodiments, the smart antenna controller 810 controls whether a particular information handling system is configured to use a 2.4+5 GHz (DBS) radio mode or a 2.4/5 GHz radio mode for each of a plurality of antennas (Ant #1), (Ant #2), in various embodiments, the smart antenna controller 810 controls the antenna power based upon a transmit power value and a number of antenna modes value. In various embodiments, the smart antenna controller 810 controls the radio portion 814 to configure one or more antenna modes via the transmit power value and the number of antenna modes value.

In various embodiments, the smart antenna controller 810 performs a region modes operation 914 which determines a region mode for one or more antennas of a particular information handling system. In various embodiments, the smart antenna controller 810 controls whether a power setting for each antenna chain for a particular information handling system is configured for a particular region. For example when the information handling system in US/FCC region, the antenna power might need to back off power by 5 dB, but when in EU country maybe backoff of 2 dB is only required due to difference in regulatory limits. In various embodiments, the smart antenna controller 810 controls the region mode based upon a region value. In various embodiments, the smart antenna controller 810 controls the radio portion 814 to configure an antenna to operation in a particular region mode via the region value.

In various embodiments, the smart antenna controller 810 performs a device mode based antenna tuning control operation 916 which determines how a smart antenna (such as smart antenna 600 or smart antenna 700) is configured for one or more device modes of a particular information handling system (e.g., a 180 device mode or a 360 device mode). In various embodiments, the smart antenna controller 810 controls whether a particular information handling system is configured to use a 2.4+5 GHz Dual Band Simultaneous (DBS) radio mode or a 2.4/5 GHz radio mode for each of a plurality of antennas (Ant #1), (Ant #2). In various embodiments, the smart antenna controller 810 controls the radio mode based upon a transmit power value and a number of antenna modes value. In various embodiments, the smart antenna controller 810 controls the radio portion 814 to configure one or more antenna modes via the transmit value and the number of antenna modes value.

Figure 10:
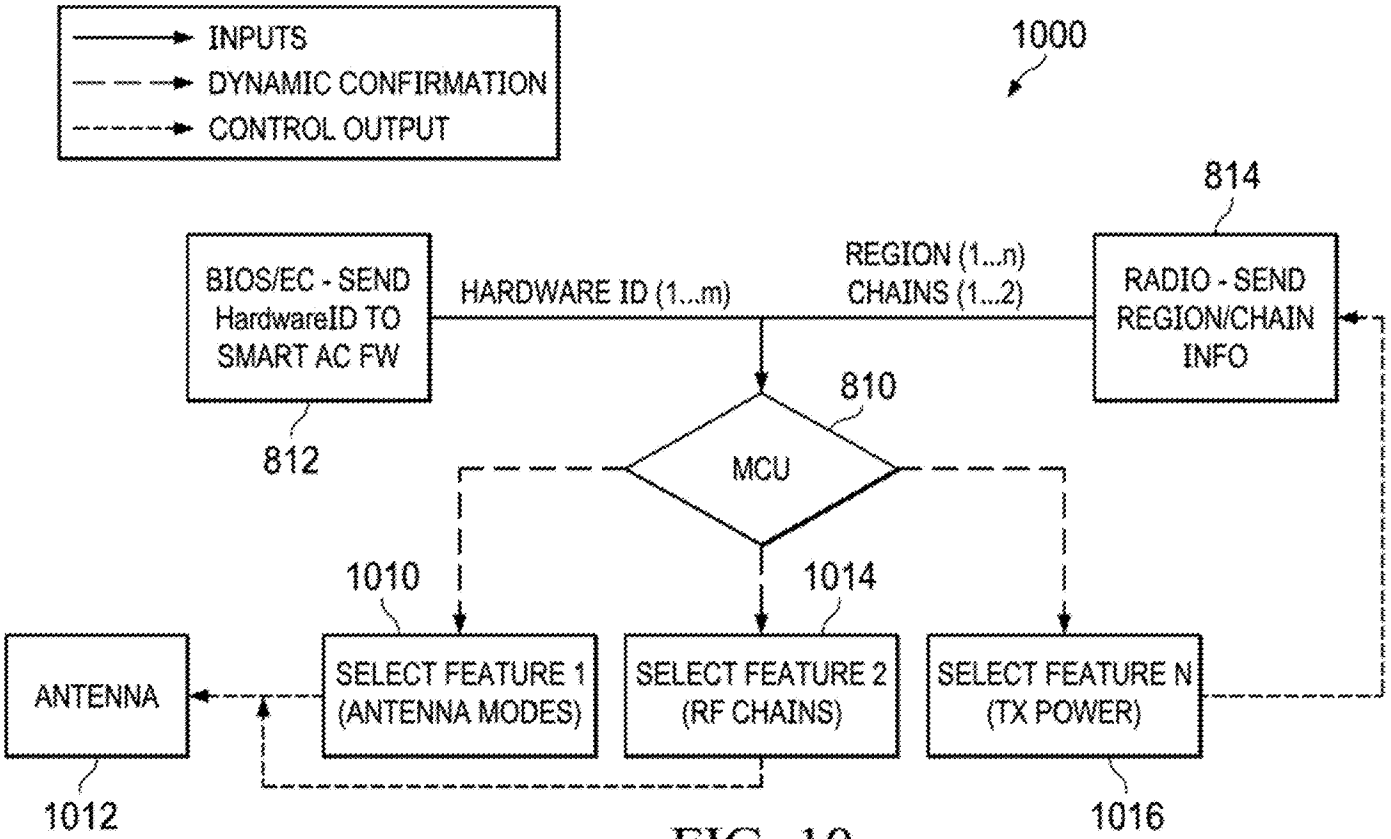
FIG. 10 shows a flow chart of the operation of a dynamic antenna configuration operation according to an embodiment of the present disclosure.

FIG. 10 shows a flow chart of the operation of a dynamic antenna configuration operation 1000 according to an embodiment of the present disclosure. More specifically, in various embodiments, the smart antenna controller 810 receives hardware identification information (Hardware ID( . . . m))from the BIOS/EC portion 812 and region information (Region (1 . . . n)) and chain information (Chains 1 . . . 2)) from the radio portion 814.

In various embodiments, a micro control unit (MCU) of the smart antenna controller 810 uses this information to configure one or more antenna configurations. In various embodiments, the smart antenna controller 810 selects an antenna mode feature 1010 and configures an antenna 1012 accordingly. In various embodiments, the smart antenna controller 810 selects an antenna radio frequency chains feature 1014 and configures the antenna 1012 accordingly. In various embodiments, the smart antenna controller 810 selects an antenna transmit power feature 1016 and configures the radio portion 314 accordingly.

Figure 11:
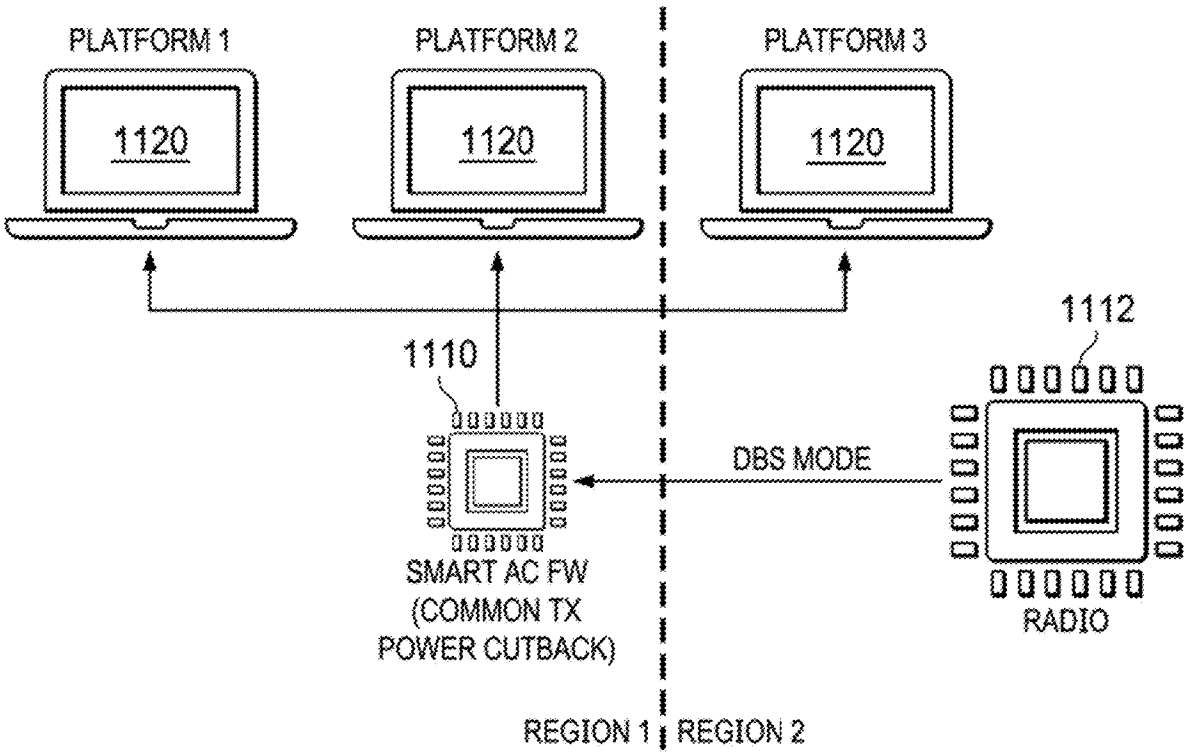
FIG. 11 shows a block diagram of an antenna power control environment according to an embodiment of the present disclosure.

FIG. 11 shows a block diagram of an antenna power control environment according to an embodiment of the present disclosure. Various aspects of the present disclosure include an appreciation that to aggregate more instantaneous bandwidth, information handling system radios can support multiple modes of transmission per antenna. In various embodiments of the present disclosure the multiple modes of operation can include a mode which simultaneously transmits on multiple bands (e.g., WiFi 2.4+5 GHz) (also referred to as Dual Band Simultaneous (DBS) mode) or a mode which includes conventional transmissions through a single band. This causes a challenge in terms of handling a specific absorption rate (SAR) power back off for conventional versus a simultaneous transmission as the radio switches transmission modes at run time due to difference in antenna SAR hotspots affected by mode of transmission, frequency, region, device mode of operation, antenna placement, per antenna, per SKU etc., across platforms. Various aspects of the present disclosure include an appreciation that know SAR solutions have a fixed power cut back across modes, RF chains, regions which provide un-optimized wireless performance resulting lower speeds.

Accordingly, in various embodiments, a smart antenna controller 1110 is provided which allows platform, region & channel specific TX power cutback when in DBS or non-DBS mode as reported by the radio while also accounting for device usage, mode, SKU etc. resulting in an optimized wireless performance. In various embodiments, the smart antenna controller 1110 includes a serial interface to a radio portion 1112 that allows the radio portion 1112 to adjust the transmit power cut backs based on a radio transmission mode (DBS/Non-DBS), device modes, region, per chain, platform SKU by able to get information from radio payload, System EC/BIOS & onboard sensor info via the various interfaces to the smart antenna controller 1110, determining optimal TX power back off table/values per SKU, per chain, per transmission mode, per device mode, per human proximity and send optimized power tables to the radio operation 1112 via a serial interface.

More specifically, in various embodiments, an antenna power control configuration system 805 includes a smart antenna controller 1110 and a radio portion 1112. In various embodiments, the smart antenna controller 810 includes smart antenna control firmware. In various embodiments the smart antenna controller 1110 is included within antenna system controller 134. In various embodiments, the radio portion 1112 is included within the radio frequency subsystems 130. In various embodiments, the smart antenna controller 1110 communicates with the radio portion 1112 via a universal asynchronous receive-transmitter (UART). In operation, the smart antenna controller 1110 receives Dual Band Simultaneous (DBS) mode information from the radio portion 1112. In various embodiments, the DBS mode information controls dual band switching of the various antenna components of an antenna system for a particular information handling system platform 1120.

Figure 12:
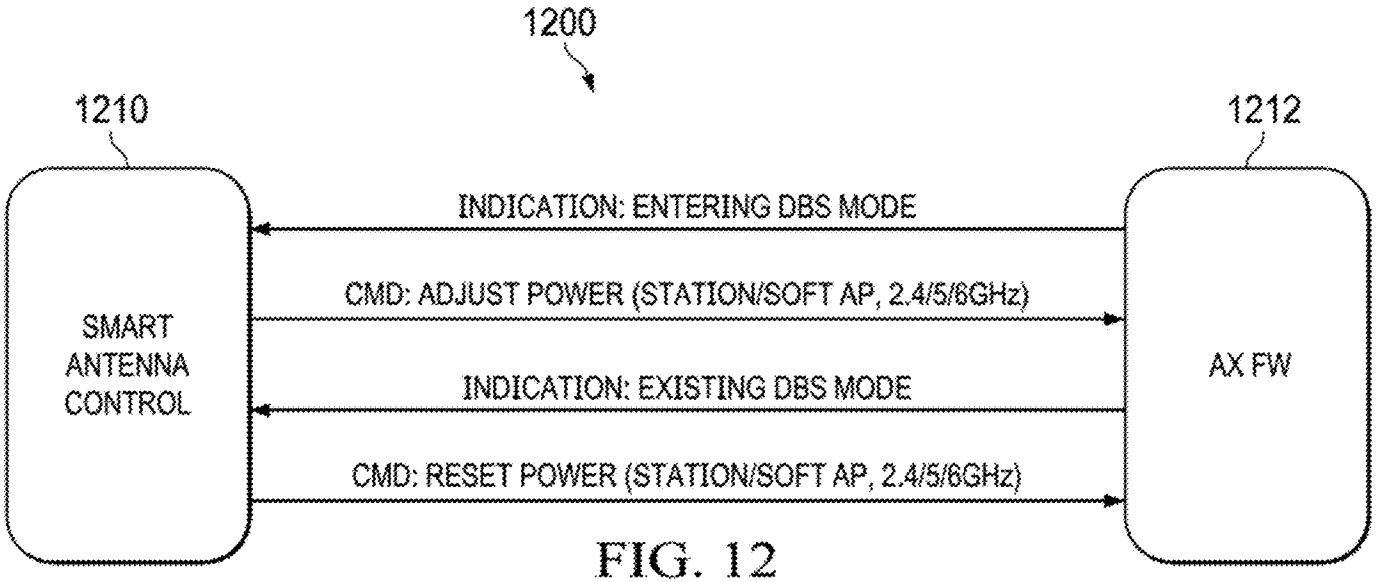
FIG. 12 shows a block diagram of an antenna power control system according to an embodiment of the present disclosure.

FIG. 12 shows a block diagram of an antenna power control system 1200 according to an embodiment of the present disclosure. In various embodiments, the power control system 1200 includes a smart antenna control portion 1210 and a DBS control portion 1212. In various embodiments, at least one of the smart antenna control portion 1210 and the DBS control portion 1212 is included within antenna power control module 144. In various embodiments, the DBS control portion 1212 includes an AX controller (e.g., a controller that conforms to the 802.11 ax standard). In various embodiments the AX controller comprises an AX firmware component. In various embodiments, the AX firmware component comprises a QCA6390 firmware component available from Qualcomm.

In various embodiments, the OBS control portion 1212 provides a DBS mode entering indication to the smart antenna control portion 1210. In various embodiments the smart antenna control portion 1210 provides a power adjust command to the DBS control portion 1212. In various embodiments, the power of the antenna may be adjusted to correspond to at least one of a station power (e.g., the antenna power for the portable information handling system operating in a normal mode of operation), a soft access point (AP) power (e.g., the antenna power when the information handling system is operating in a hotspot mode of operation, a 2.4 GHz power, a 5 GHz power and a 6 GHz power. In general, power refers to a maximum RF output power transmitted by the radio at the respective WiFi bands, e.g., the 2.4 GHz band, the 5 GHz band and the 6 GHz band) In various embodiments, the power of the antenna is adjusted by the DBS control portion 1212. In various embodiments, the DBS control portion 1212 provides an existing OBS mode indication to the smart antenna control portion 1210. In various embodiments the smart antenna control portion 1210 provides a reset power command to the OBS control portion 1212. In various embodiments, the power of the antenna may be reset to correspond to at least one of a station power, a soft access point (AP) power, a 2.4 GHz power, a 5 GHz power and a 6 GHz power. In various embodiments, the power of the antenna is reset by the DBS control portion 1212.

Figure 13:
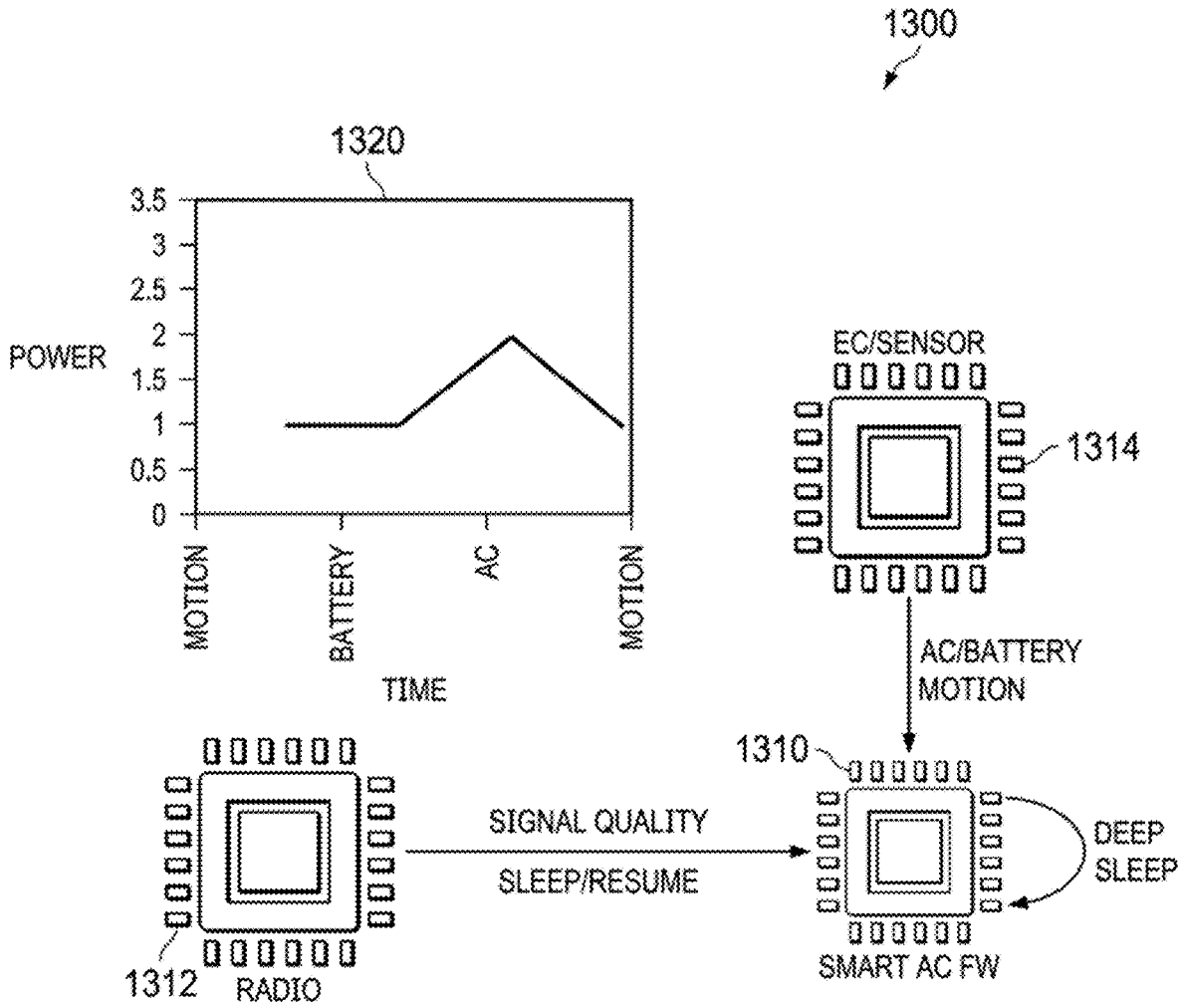
FIG. 13 shows a block diagram of an antenna power control system according to an embodiment of the present disclosure.

FIG. 13 shows a block diagram of a contextually aware antenna power control system 1300 according to an embodiment of the present disclosure.

Various aspects of the present disclosure include an appreciation that a smart antenna controller may be used to communicate with a WLAN radio via a serial interface receiving radio parametric periodically (low latency) to learn about the signal environment and adapt antennas to recover device out of deep fade. Various aspects of the present disclosure include an appreciation that a WLAN radio may lose its configuration state across power cycles and may stop sending radio packets to the antenna controller. Various aspects of the present disclosure include an appreciation that information handling systems with certain types of standby modes of operation may have additional power saving requirements across various system states that could further impact WLAN radio communication to a smart antenna controller thus impacting the smart antenna averaging operations. Various aspects of the present disclosure include an appreciation that it is desirable for a smart antenna controller to effectively manage its power consumption while not impacting the communication to radio that could impact operation efficiency and the intended enhancements in wireless performance.

Accordingly, in various embodiments, a smart antenna controller includes a smart Antenna serial messaging protocol that includes power saving capability whenever the smart antenna controller detects the information handling system is on battery power, is in proximity of motion and/or signal quality variation. In various embodiments, the smart antenna controller serial messaging protocol implements an intelligent notification, handshake, timing mechanism to restore radio communication and configuration states across power cycles thus ensuring seamless operation of the antenna systems. In various embodiments, the smart antenna controller can reduce power consumption by implementing deep sleep whenever the information handling system is on battery power by reducing the analytics and data gathering. In various embodiments, a similar approach may be used when the information handling system is in motion (e.g., as indicated via accelerometer inputs) where it may be not be fruitful to optimize antenna switching. In various embodiments, the smart antenna controller may reduce power consumption when it detects significant signal strength variation notification from radio, by temporarily disabling its analytics and/or optimization logic.

More specifically, in various embodiments, a contextually aware antenna configuration system includes a smart antenna controller 1310, a radio portion 1312 and an EC/sensor portion 1314. In various embodiments, the smart antenna controller 1310 includes smart antenna control firmware. In various embodiments the smart antenna controller 1310 is included within antenna system controller 134. In various embodiments, the radio portion 1310 is included within the radio frequency subsystems 130. In various embodiments, the smart antenna controller 1310 receives signal quality information and sleep/resume information from the radio portion 1312. In various embodiments, the smart antenna controller 1310 communicates with the radio portion 1314 via a universal asynchronous receive-transmitter (UART). In operation, the smart antenna controller 1310 receives alternating current (AC)/Battery or motion information from the EC/sensor portion 1314. In various embodiments, the smart antenna controller 1310 receives various system activity inputs such as whether the information handling system is being powered via an AC adaptor or whether the information handling system is being powered by a battery, whether the information handling system is stationary (e.g., placed on a desk) or in motion (e.g., due to a user carrying the information handling system) from the on-board system EC (Embedded Controller) or ISH (Integrated Sensor Hub). The smart antenna controller 1310 adapts the antenna system configuration based on the usage or activity of information handling system.

In various embodiments, the smart antenna controller 1310 controls the power level of the antennas within the information handling system platform. In various embodiments, the power level is adjusted based upon whether the information handling system is in a batter mode of operation, an AC power connected mode of operation or when motion of the information handling system is detected. Table 1320 provides an example of a plurality of power level transitions based upon the mode of operation of the information handling system.

Figure 14:
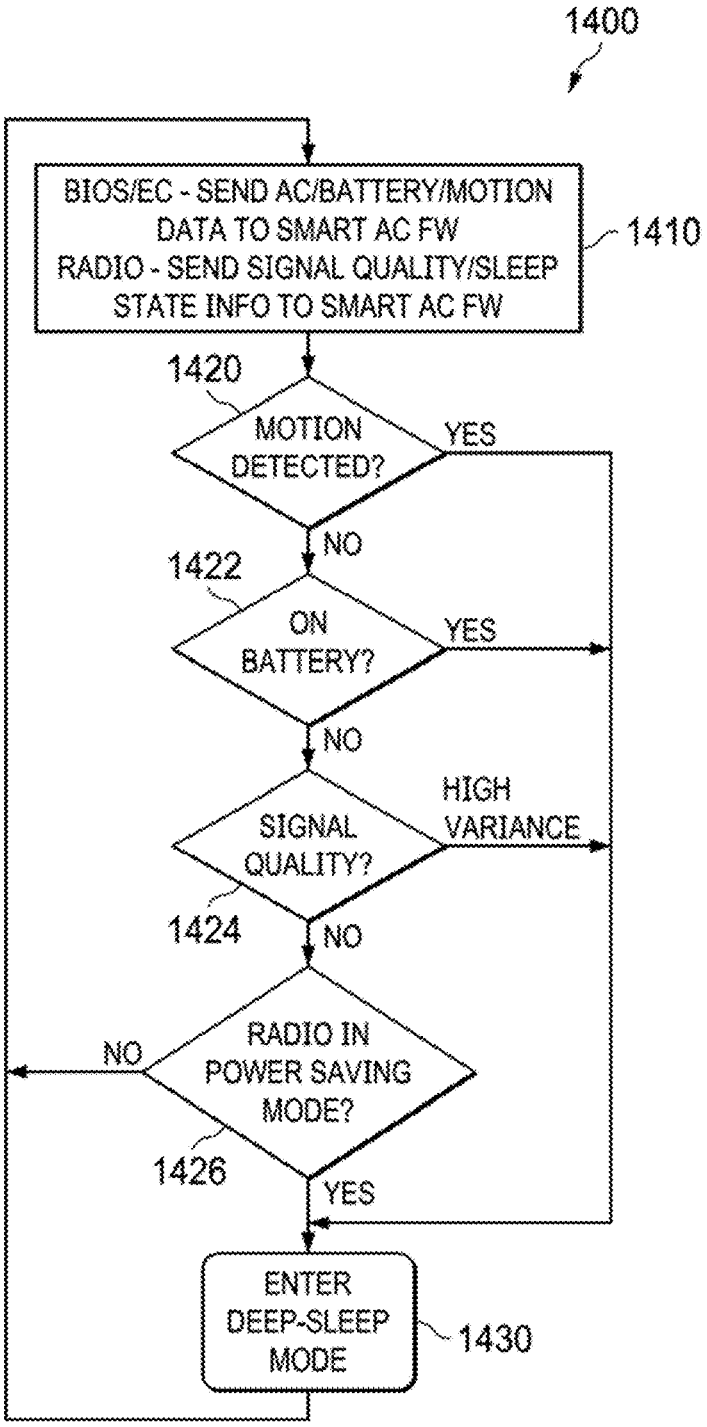
FIG. 14 shows a flow chart of the operation of an antenna power control operation according to an embodiment of the present disclosure.

FIG. 14 show a flow chart of the operation of an antenna power control operation according to an embodiment of the present disclosure. In various embodiments the antenna power control operation provides contextually aware antenna power control. More specifically, in various embodiments, at step 1410 the smart antenna control portion receives signal quality information and sleep/resume information from the radio portion 1312 and alternating current (AC)/Battery or motion information from the EC/sensor portion 1314. Next, at step 1420, the smart antenna control portion 1310 uses the received information to determine whether motion has been detected of the information handling system. If motion has not been detected, the smart antenna control portion 1310 uses the received information to determine whether the information handling system is operating in a battery mode of operation at step 1422. If the information handling system is not operating in a battery mode of operation, the smart antenna control portion 1310 uses the received information to analyze the signal quality of the send signal of the radio portion 1312 at step 1424. If the signal quality of the send signal does not have high variability, the smart antenna control portion 1310 uses the received information to determine whether the radio portion 1312 is operating in a power saving mode of operation at step 1426. If the radio portion is not operating in a power saving mode of operation, the operation returns to awaiting receipt of additional signal quality information and/or sleep/resume information from the radio portion 1312 and/or alternating current (AC)/Battery or motion information from the EC/sensor portion 1314 at step 1410. If the smart antenna control portion determines that motion is detected at step 1420, the information handling system is operating in a battery mode of operation at step 1422, the signal quality is highly variable at step 1424 or the radio portion is operating in a power saving mode of operation at step 1426, then the smart antenna control portion causes the antenna systems 132 to enter a deep sleep mode of operation at step 1430. More specifically, when the antenna controller enters the deep sleep mode of operation, the antenna controller no longer scans for an incoming radio signal or operates antenna switches to change antenna directivity in scenarios where there is no change in signal strength reported by the radio to the controller or when the radio reports the controller that it is operating in a power saving mode where there is not activity causing the signal strength to change.

The above-disclosed subject matter is to be considered illustrative, and not restrictive, and the appended claims are intended to cover any and all such modifications, enhancements, and other embodiments that fall within the scope of the present invention. Thus, to the maximum extent allowed, by law, the scope, of the present invention is to be determined by the broadest permissible interpretation of the following claims and their equivalents, and shall not be restricted or limited by the foregoing detailed description.

What is claimed is:

1. A computer-implementable method for controlling a smart antenna within an information handling system, comprising:

providing the smart antenna with at least one configurable aspect, the smart antenna being information handling system platform agnostic, the smart antenna supporting different information handling system platforms having different configuration needs and feature selection, the smart antenna comprising a single firmware image that can be dynamically configured to identify platform specific configuration and feature selection;

obtaining information regarding the at least one configurable aspect, the information regarding the at least one configurable aspect including information regarding in which of a plurality of information handling system platforms the smart antenna is included; and, controlling configuration of the at least one configurable aspect of the smart antenna based upon the information regarding the at least one configurable aspect of the smart antenna, the controlling being performed via a smart antenna control system, the smart antenna control system comprising a dynamic antenna configuration module and an antenna power control module, the dynamic antenna configuration module controlling configuration of a configurable antenna feature, the antenna power control module controlling configuration of an antenna power configuration, the controlling the at least one configuration aspect of the smart antenna configuring the at least one configuration aspect of the smart antenna for a particular information handling system platform of the plurality of information handling systems.

2. The computer-implementable method of claim 1, wherein:

the at least one configurable aspect comprises the configurable antenna feature.

3. The computer-implementable method of claim 2, wherein:

the configurable antenna feature comprises a number of antenna chains feature, an antenna transmit power feature, a number of antenna modes feature, a number of antenna device modes feature, a number of module vendors feature and a region feature.

4. The computer-implementable method of claim 1, wherein:

the at least one configurable aspect comprises the antenna power configuration.

5. The computer-implementable method of claim 4, wherein:

the antenna power configuration aspect comprises a dual band simultaneous power configuration.

6. The computer-implementable method of claim 4, wherein:

the antenna power configuration aspect comprises an antenna power state configuration.

7. A system comprising:

a processor;

a data bus coupled to the processor;

a smart antenna system, the smart antenna system comprising at least one configurable aspect, the smart antenna being information handling system platform agnostic, the smart antenna supporting different information handling system platforms having different configuration needs and feature selection, the smart antenna comprising a single firmware image that can be dynamically configured to identify platform specific configuration and feature selection; and a non-transitory, computer-readable storage medium embodying computer program code, the non-transitory, computer-readable storage medium being coupled to the data bus, the computer program code interacting with a plurality of computer operations and comprising instructions executable by the processor and configured for:

obtaining information regarding the at least one configurable aspect, the information regarding the at least one configurable aspect including information regarding in which of a plurality of information handling system platforms the smart antenna is included; and, controlling configuration of the at least one configurable aspect of the smart antenna based upon the information regarding the at least one configurable aspect of the smart antenna, the controlling being performed via a smart antenna control system, the smart antenna control system comprising a dynamic antenna configuration module and an antenna power control module, the dynamic antenna configuration module controlling configuration of a configurable antenna feature, the antenna power control module controlling configuration of an antenna power configuration, the controlling the at least one configuration aspect of the smart antenna configuring the at least one configuration aspect of the smart antenna for a particular information handling system platform of the plurality of information handling systems.

8. The system of claim 7, wherein:

the at least one configurable aspect comprises the configurable antenna feature.

9. The system of claim 8, wherein:

the configurable antenna feature comprises a number of antenna chains feature, an antenna transmit power feature, a number of antenna modes feature, a number of antenna device modes feature, a number of module vendors feature and a region feature.

10. The system of claim 7, wherein:

the at least one configurable aspect comprises the antenna power configuration.

11. The system of claim 10, wherein:

the antenna power configuration aspect comprises a dual band simultaneous power configuration.

12. The system of claim 10, wherein:

the antenna power configuration aspect comprises an antenna power state configuration.

13. A non-transitory, computer-readable storage medium embodying computer program code for controlling a smart antenna, the smart antenna comprising at least one configurable aspect, the smart antenna being information handling system platform agnostic, the computer program code comprising computer executable instructions configured for:

obtaining information regarding the at least one configurable aspect, the information regarding the at least one configurable aspect including information regarding in which of a plurality of information handling system platforms the smart antenna is included, the smart antenna supporting different information handling system platforms having different configuration needs and feature selection, the smart antenna comprising a single firmware image that can be dynamically configured to identify platform specific configuration and feature selection; and, controlling configuration of the at least one configurable aspect of the smart antenna based upon the information regarding the at least one configurable aspect of the smart antenna, the controlling being performed via a smart antenna control system, the smart antenna control system comprising a dynamic antenna configuration module and an antenna power control module, the dynamic antenna configuration module controlling configuration of a configurable antenna feature, the antenna power control module controlling configuration of an antenna power configuration, the controlling the at least one configuration aspect of the smart antenna configuring the at least one configuration aspect of the smart antenna for a particular information handling system platform of the plurality of information handling systems.

14. The non-transitory, computer-readable storage medium of claim 13, wherein:

the at least one configurable aspect comprises the configurable antenna feature.

15. The non-transitory, computer-readable storage medium of claim 14, wherein:

the configurable antenna feature comprises a number of antenna chains feature, an antenna transmit power feature, a number of antenna modes feature, a number of antenna device modes feature, a number of module vendors feature and a region feature.

16. The non-transitory, computer-readable storage medium of claim 13, wherein:

the at least one configurable aspect comprises the antenna power configuration.

17. The non-transitory, computer-readable storage medium of claim 16, wherein:

the antenna power configuration aspect comprises a dual band simultaneous power configuration.

18. The non-transitory, computer-readable storage medium of claim 16, wherein:

the antenna power configuration aspect comprises an antenna power state configuration.

19. The non-transitory, computer-readable storage medium of claim 13, wherein:

the computer executable instructions are deployable to a client system from a server system at a remote location.

20. The non-transitory, computer-readable storage medium of claim 13, wherein:

the computer executable instructions are provided by a service provider to a user on an on-demand basis.

* * * * *